US005123367A

United States Patent [19]

Black et al.

[11] Patent Number: 5,123,367

[45] Date of Patent: Jun. 23, 1992

[54] METHOD AND APPARATUS FOR FORMING AND STACKING A FOLDED SEWN PLY SUCH AS A V-TOP SHIRT POCKET

[75] Inventors: Marshall Black; C. Ray Hamilton, both of Vidalia; Ralph Hackle, Adrian, all of Ga.

[73] Assignee: Oxford Industries, Inc., Vidalia, Ga.

[21] Appl. No.: 431,372

[22] Filed: Nov. 3, 1989

[51] Int. Cl.[5] ..... D05B 21/00

[52] U.S. Cl. ..... 112/262.3; 112/121.12; 112/121.29; 112/141; 112/147; 112/DIG. 2

[58] Field of Search ..... 112/121.12, 121.15, 112/121.29, 2, 147, 141, 262.3, DIG. 2, DIG. 3; 223/37, 38

[56] References Cited

U.S. PATENT DOCUMENTS

| | | | |
|---|---|---|---|
| 3,277,851 | 10/1966 | Dobner | 112/121.12 |
| 3,358,626 | 12/1967 | Bryan | 112/121.12 |
| 3,386,396 | 6/1968 | Jacobs et al. | 112/121.12 |
| 3,611,957 | 10/1971 | Beazley | 112/121.29 |
| 3,640,235 | 2/1972 | Burton | 112/121.29 |
| 3,653,347 | 4/1972 | Bianchi | 112/121.12 |
| 3,769,924 | 11/1973 | Rogers et al. | 112/121.29 |
| 3,789,781 | 2/1974 | Carson et al. | 112/121.12 X |
| 3,898,941 | 8/1975 | Crawford et al. | 112/121.29 |
| 4,095,537 | 6/1978 | Silverman et al. | 112/121.29 |
| 4,144,825 | 3/1979 | Angele et al. | 112/121.29 |
| 4,428,315 | 1/1984 | Keeton | 112/121.12 X |
| 4,458,610 | 7/1984 | Dowell | 112/147 |
| 4,463,697 | 8/1984 | Vogt et al. | 112/147 X |
| 4,493,276 | 1/1985 | Sadeh | 112/121.12 |
| 4,550,670 | 11/1985 | Thompson et al. | 112/121.11 |
| 4,621,585 | 11/1986 | Ball et al. | 112/121.29 X |
| 4,730,756 | 3/1988 | Flavell et al. | 112/121.29 X |
| 4,756,261 | 7/1988 | Gershoni | 112/121.12 X |
| 4,787,325 | 11/1988 | Black et al. | 112/121.29 |
| 4,947,771 | 8/1990 | Miyachi et al. | 112/141 |
| 4,957,052 | 9/1990 | Sotome et al. | 112/147 |

OTHER PUBLICATIONS

Brochure entitled "Jet Sew V-Top Pocket Hemmer" by Jet Sew.

*Primary Examiner*—Peter N. Nerbun
*Attorney, Agent, or Firm*—Jones, Askew & Lunsford

[57] ABSTRACT

An automatic apparatus and method for forming a V-top shirt pocket or similar article with a folded region, sewing a stitch to hold the fold, and stacking a plurality of same with distributed hem build-up. An unfolded ply of material is provided to a folding station, which forms a tucked edge fold in the material. The ply is then held at the tucked edge, and the opposite end is folded over a folding rod with an air jet. Holding fingers descend to hold the fold in the ply. A transport carriage arrives at the folding station to retrieve the folded, edge-tucked ply. The transport carriage includes a clamp, which clamps on the folded, edge-tucked ply to hold the fold and edge tuck as the folding station elements retract. The transport carriage carries the folded, edge-tucked held ply through a sewing station in synchronization with a sewing machine, where a V-shaped hem is sewn. The transport carriage is biased against a pattern cam as the ply is carried through the sewing station and sewn, to form a sewn pattern. The transport carriage then carries the ply to a stacking station. At the stacking station, the sewn pocket is deposited atop a stack plate. Holding fingers positively hold the sewn pocket against the stack plate. The transport carriage returns to the folding station to retrieve another ply. The stack plate withdraws, and the holding fingers positively urge the sewn pocket against the top of a stack. An improved stack table holding the stack of plies descends and rotates 90 degrees, to distribute build-up in stack thickness due to the folded sewn region.

24 Claims, 14 Drawing Sheets

METHOD AND APPARATUS FOR FORMING AND STACKING A FOLDED SEWN PLY SUCH AS A V-TOP SHIRT POCKET

TECHNICAL FIELD

This invention relates generally to material handling and sewing, and particularly relates to a method and apparatus for folding a ply of material, sewing a hem along the fold, and stacking the sewn folded plies automatically, particularly suitable for use in making a V-shaped pocket for presently fashionable men's dress shirts.

BACKGROUND

In the garment manufacturing industry, the production of clothing is accomplished by cutting large, rectangular pieces of material from 100–150 yard rolls, placing stacks of the rectangular pieces of material on a market table for cutting, and positioning a pattern for cutting this material on top of the stack. Cutting of the material is performed either by handknife or by an automatic cloth cutter such as a laser cutter. A computer optimizes the placement of the patterns on the cloth to maximize usage of material. After cutting, the material from which clothing is to be manufactured must be bundled and carried to further processing stations where the material is folded, sewn, or subjected to further processing operations.

One particular type of folded ply encountered in the manufacture of men's dress shirts is the V-top pocket. Many currently fashionable men's dress shirts typically include a breast or pen pocket which has a V-shaped seam on the lower edge and a corresponding V-shaped upper portion or region at the upper part of the pocket, the result of folding a section of the ply under the ply and sewing the folded edge to the ply with a V-shaped stitch. The edges of the V-shaped upper portion are often folded under the seam, to present a smooth, non-fraying boundary when the pocket is sewn to the shirt.

Most if not all V-top pocket are sewn by hand, because of the tedious nature of folding the edge of the ply under the ply before sewing the upper portion to form the V-shaped upper region. Prior to the present invention, it was not thought possible to automate the manufacture of V-top pockets to include the steps of folding the edges under, folding the V-top, sewing the top, and stacking.

A particular difficulty encountered in the manufacture of V-top pockets is the slight folding or undertuck of the edge of the material into the seam. This slight fold or tuck is between ¼" and ⅜", with a stitch margin of 1/32" to 1/16". The fold or tuck is difficult to make with machinery because of the pliability of the cloth material. Another problem is the formation of the folded upper portion of the pocket, while holding the folded edge in place. Use of an apparatus which transfers the ply with a folded edge to another workstation for forming the fold risks loss of the edge fold unless the folded edge is clamped in place during movement between workstations. Yet another difficulty is the sewing of the V-shaped stitch or seam, while holding the edge fold and the upper portion fold in place.

One approach to forming the tucked edge in a straight hem pocket is shown in U.S. Pat. No. 3,898,941 to Crawford et al. In this patent, the upper portion fold and edge tuck are formed by moving the ply of material along a path on an endless belt, and guiding the edges with folding plates into folded and tucked positions as the ply is moved along the path. While this method works most of the time, occasionally the edge will get double folded or the entire ply will be displaced from the endless belt, since the ply is not positively held during the folding and tucking operation. Moreover, this apparatus can only make a straight hem, and because of its construction cannot form or sew a "V" or other contoured seam.

After a single pocket is folded and sewn, there still remains the problem of stacking the folded pockets so that they may be bundled for transfer to another processing station, such as sewing to the shirt plackets. Since folded plies such as the V-top pocket are thicker at one end than the other due to the fold, it has proven difficult to automatically stack the material due to the tendency of the stack to grow higher toward the end with the fold than at the opposite end. This unevenness in stack height at opposite ends of the stack presents a problem in presenting a stacking surface for pockets presented for stacking and bundling.

Some prior art stacking devices suffer from skewed, uneven stacks due to dropping of a ply onto the stack. This generally results from releasing the article to be stacked to fall onto the stack without positive guidance. Since pliable cloth pockets are susceptible to air currents and unevenness in the stacking surface, releasing a pocket to fall on to the top of a stack often results in skewed or uncentered stacking. This slows down subsequent operations since an operator or subsequent processing machine cannot be certain of picking up an edge of a pocket at the same place in the stack every time.

One approach to the problem of stacking is shown in U.S. Pat. No. 4,787,325 to Black et al., which is owned by the assignee of the present invention. This approach involves use of a tiltable stacking surface to compensate for uneven height of the ends of the stack.

Another approach is described in the above U.S. Pat. No. 3,898,941 to Crawford et al., which employs a revolvable stack cartridge which rotates to compensate for build-up of a hem in a hemmed fabric piece such as a pocket. The fabric piece is delivered to the stacker cartridge by a stacker endless belt, and an elevator with spaced-apart lands which lifts the piece off the endless belt and "stuffs" the piece upwardly into a cartridge bottom opening. One drawback to this approach is that while the cartridge rotates to distribute the plies around the stack, the delivery method relies upon the resilience of the fabric piece to reassume or "remember" its flatness when the elevator withdraws so that the fabric piece will be retained within the cartridge. For thin pieces of material such as pinpoint oxford cloth cotton shirt material, this delivery method is rough on the material, is not reliable, and sometimes results in creases in the pocket. Moreover, the stacker shown in this patent is limited in the size range of plies it can handle, because of the fixed opening size in the cartridge bottom.

SUMMARY OF THE INVENTION

The present invention overcomes these and other difficulties encountered in prior art and manual approaches to forming folded sewn plies by providing an apparatus and method for forming a folded sewn ply from a precut, unsewn ply of material and automatically stacking same. After an operator manually places a precut, unsewn ply of material in the appropriate position on the present invention, the system is fully automatic. The folded edge is positively held at all times during all operations, thereby minimizing the risk of loss of fold during movement between workstations.

Briefly described, the present invention comprises an apparatus and method for forming a folded ply of material with a tucked edge such as a V-top pocket, sewing a V-shaped or other patterned seam in the ply, and stacking the sewn folded plies automatically, with even distribution of build up of the thickness of the pockets in the stack. After the precut, unsewn ply of material is appropriately positioned and aligned by an operator, an automatic folding station folds the material in a generally V-shape to form a folded region while one edge is held. After folding, the material is grasped by a transport carriage with the folded edge held in place, withdrawn from the folding station, and transported to a sewing station. While the ply and fold is still held by the transport carriage, the ply is guided through a preset course under the needle of a sewing machine, synchronized to the sewing machine, and the folded region is stitched to hold the fold in place.

After stitching, the sewn folded ply, which is thicker at one end than the other due to the sewn fold, is transported to a stacking station. Before the transport carriage releases its grip on the ply, holding fingers extend from the stacking station, holding the sewn ply in place. To ensure a neat, centered stack, the surface upon which the folded plies are stacked is rotated 90 degrees each time a new ply is added to the stack. When the stack is full, a proximity detector generates an alarm which informs the operator of the need to empty the stacking station.

More particularly described, the preferred embodiment of the present invention comprises a folding station, a transport carriage for transferring material from the folding station to subsequent processing, a sewing station for sewing a folded ply, and a stacking station. The folding station forms a generally a V-shaped folded ply of material from a precut, unsewn ply of material. After the operator places the precut, unsewn ply of material on a work plate at the folding station and presses a start button, a top fold blade lowers onto the ply of material. A bottom fold blade then moves forward, and a folding edge of the bottom fold blade causes the ply of material to fold in a generally V-shape, with a tucked lateral or leading edge. Bottom holding fingers then raise to hold the folded edge of the ply in place, and the work plate upon which the ply was initially placed retracts, causing the unsupported edge of the ply to dangle loosely.

The top fold blade then retracts and returns to its initial position, so as to enable a fold over rod to move into position over the dangling ply. An aluminum block or manifold containing numerous air jets then rises under the dangling ply. The air jets are activated as the manifold rises, blowing and folding the ply over the fold over rod. Top holding fingers then extend down to the folded ply to keep the now-folded ply from unfolding. It should also be recognized that the folding of the ply over the fold over rod can be accomplished by mechanical means rather than air jets. A transport carriage, which will transport the ply from station to station, then moves into the folding station and a clamp on the transport carriage closes on the ply, holding the folds in the ply firmly. The top and bottom holding fingers, the fold-over rod, and the fold blades then retract to their initial position, awaiting the next ply. The transport carriage then moves to the sewing station, transporting the ply to the next step in the system.

At the sewing station, the ply follows a path which guides the ply under the needle of the sewing machine. The ply is moved through the sewing station with the transport carriage, which is biased against a pattern cam or guide as it moves through the sewing station. In the preferred embodiment, the pattern is a generally V-shaped pattern to form a V-top pocket, but other patterns could be employed. As the folded ply passes under the needle of the sewing machine, it is stitched to hold the fold in place, in synchronization with the sewing machine. After the sewing is completed, the transport carriage then transports the now-sewn ply to the stacking station.

At the stacking station, stacker hold fingers extend to bias the ply firmly in place as the ply is delivered. The clamp on the transport carriage then opens and the transport carriage retracts, leaving the folded, sewn ply on a stacker plate, held underneath the stacker hold fingers. The transport carriage then returns to its initial position immediately outside the folding station. The stacker plate then retracts, positively depositing the ply on the stack box. Once the ply is positioned at the top of the stack, the stacker hold fingers retract, the stack box descends a predetermined distance to allow clearance for the return of the stacker plate, and the stack box rotates 90 degrees. These movements of the stack box permit detection of a full box with sensors and facilitate neat, centered stacking, respectively. The stacker plate then extends back over the top of the stack box, readying itself for the arrival of the next sewn ply. Finally, the stack box moves up until the stack of plies is directly beneath the stack plate, as detected by a sensor.

Accordingly, it is an object of the present invention to provide an improved apparatus and method for forming a V-top pocket for a men's dress shirt.

It is another object of the present invention to provide an apparatus for forming a folded ply of material.

It is another object of the present invention to provide an improved apparatus and method for folding, sewing, and stacking a plurality of substantially flat workpieces such as folded plies of cloth material.

It is another object of the present invention to provide an improved method for forming a folded sewn ply of material such as a pocket wherein the folded edge of the ply is positively held during folding, movement to a sewing station, and sewing, to minimize risk of loss of the fold.

It is another object of the present invention to provide an apparatus for transporting a folded ply of material from one work station through a second work station and on to a third work station, while positively holding the fold in the ply.

It is another object of the present invention to provide an improved apparatus and method for stacking separate substantially flat work pieces.

It is another object of the present invention to provide an improved apparatus and method for stacking substantially flat workpieces which have a greater thickness at one end than another due to a fold or the like in the workpiece, which always presents a substantially level stacking surface to the next workpiece to be presented for stacking.

It is another object of the present invention to provide an improved apparatus and method for stacking substantially flat workpieces which always maintains positive article control to promote neat, even, and unskewed stacking.

It is another object of the present invention to provide an apparatus and method for forming and handling a separate ply of material such as a shirt pocket which obviates alignment difficulties and skewed stitches by always positively handling the material through all processing steps.

These other objects, features, and advantages of the present invention may be more clearly understood and appreciated from a review of the following detailed description of the preferred embodiment and by reference to the appended drawings and claims.

DETAILED DESCRIPTION OF THE PREFERRED EMBODIMENT

Figure 1:
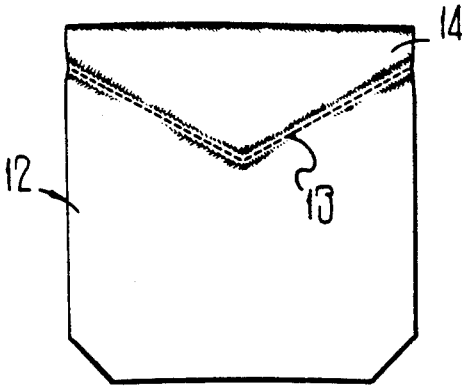
FIG. 1 illustrates a V-top pocket which is made with the method and apparatus constructed in accordance with the preferred embodiment of the present invention.
Figure 2:
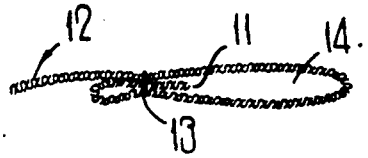
FIG. 2 is an end view of the sewn, folded pocket of FIG. 1.

Referring now to the drawings, in which like numerals indicate like elements throughout the several views, FIG. 1 shows a V-top shirt pocket 12 which is exemplary of the types of workpieces which can be made and stacked with the preferred embodiment of the present invention. The pocket 12 has a V-shaped hem or stitch 13, which fastens a folded upper portion 14 of the pocket material to the pocket. The folded upper portion 14, as best seen in FIG. 2, comprises two plies of shirt material. The hem or stitch 13 has a tucked or folded edge 11.

Figure 3:
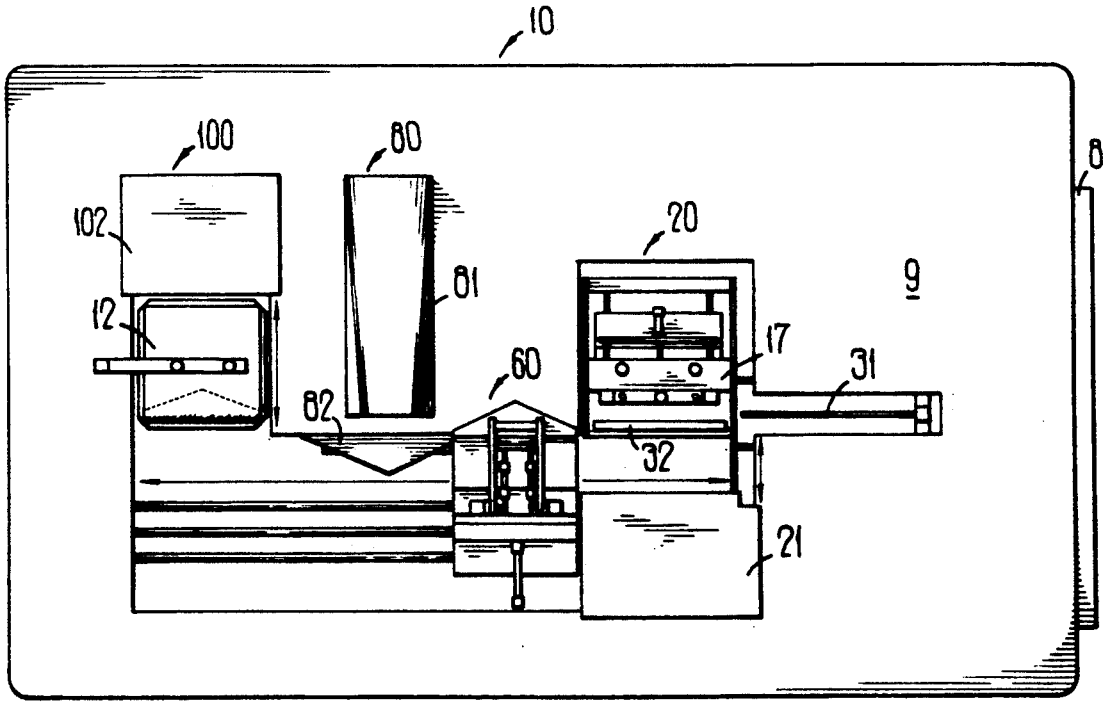
FIG. 3 schematically illustrates an apparatus constructed in accordance with the preferred embodiment of the present invention.

Referring now to FIG. 3, an apparatus 10 constructed in accordance with the present invention, which carries out the preferred method steps, comprises a folding station 20, a sewing station 80, a stacking station 100, and a transport carriage 60 for grasping a workpiece at the sewing station, transporting the workpiece along a path along a table top 9 through the sewing station, and depositing the workpiece at the stacking station. The operations of the these preferred workstations are described in connection with the preferred method of the present invention.

The preferred embodiment of the present invention employs a programmable controller 8 (shown generally in FIG.5) to control the sequences of actuation of electric motors and pneumatic cylinders, identified as PNn, employed as the prime movers. The controller receives input signals from limit switches and other sensors, and provides signal outputs to activate solenoid valves and relays to control the pneumatic cylinders and electric motors. The preferred embodiment employs a model C28K-CDR-A programmable controller commercially available from Omron Electronics, Inc., of Schaumburg, Ill. Details of the construction, hook-up, and programming of the preferred controller 8 are available in the literature supplied by the manufacturer. Those skilled in the art will understand how to program such a programmable controller to perform the steps described below in connection with FIG. 4 taken by the herein-described apparatus to form the V-top pocket, sew the hem, and stack same.

FIG. 4 illustrates the steps taken in the disclosed preferred embodiment for forming a generally V-shaped pocket from a single ply of material, sewing the ply, and transporting the sewn folded ply from a sewing station to a stacking station, all the while maintaining continuous contact with the ply and any folded regions to hold folds in place and ensure neat, precise, centered handling, sewing, and stacking. Referring first to FIG. 4A, an operator (not illustrated) places a single ply of precut, unfolded, unsewn cloth material 12 on a generally flat, rectangularly shaped, metal work plate 21 at the folding station 20. The front edge **12*a* of the ply of material will be aligned with and adjacent to the edges of a bottom fold blade assembly 27, as shown in the expanded side view associated with FIG. 4A. The operator then depresses a start button (not illustrated) which activates the controller 8** to start the automated process of folding, transporting, sewing, and stacking.

Figure 4A:
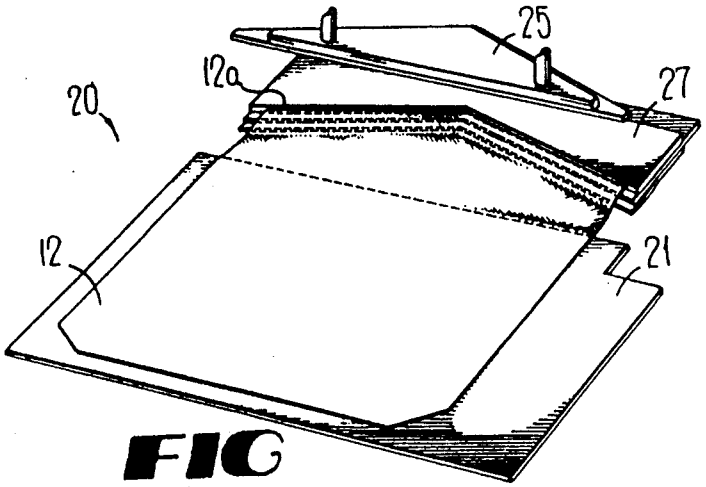
FIG. 4, consisting of FIGS. 4A–4P, illustrates the steps taken in the preferred method and embodiment of the present invention to form a generally V-shaped folded and sewn ply and for stacking same.
Figure 4B:
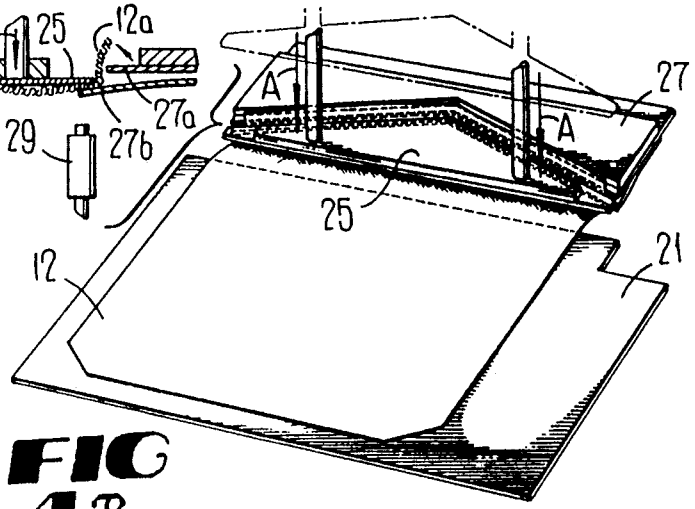

A generally V-shaped top fold blade 25 then lowers in the direction of arrow A onto the ply of material 12, leaving a generally V-shaped edge of material **12*a* extending outwardly and protruding slightly upwardly, as illustrated in FIG. 4B. The top fold blade 25 presses against the springy bottom fold blade 27, so that the edge 12*a* sticks up slightly. In FIG. 4C, the bottom fold blade unit 27, having a top blade 27*a* and a bottom blade 27*b*, then moves forward in the direction of arrow B and folds the edge of material 12*a* over the top fold blade 25, as illustrated in the expanded side view associated with FIG. 4C. This forms the tucked edge 11 of FIG. 2. After FIG. 4C, the top fold blade 25 is positioned to extend slightly in between the top blade 27*a* and the bottom blade 27*b***.

Also in FIG. 4C, a plurality of bottom holding fingers **29*a*, 29*b*, . . . 29*g* raise in the direction of arrow C from below the bottom fold blade unit 27 to hold the now-folded edge 11 of the ply of material 12 on the stitch line 13. Because the bottom fold blades 27 are made from spring metal sheets, the bottom holding fingers 29*a*, 29 *b*, . . . 29*g* bias the blades 27 together to clamp and hold the tuck 11 in place. In the preferred embodiment, seven (7) holding fingers 29 are employed, powered by pneumatic cylinders, to evenly distribute the biasing force along the length of the blades 27**.

Figure 4D:
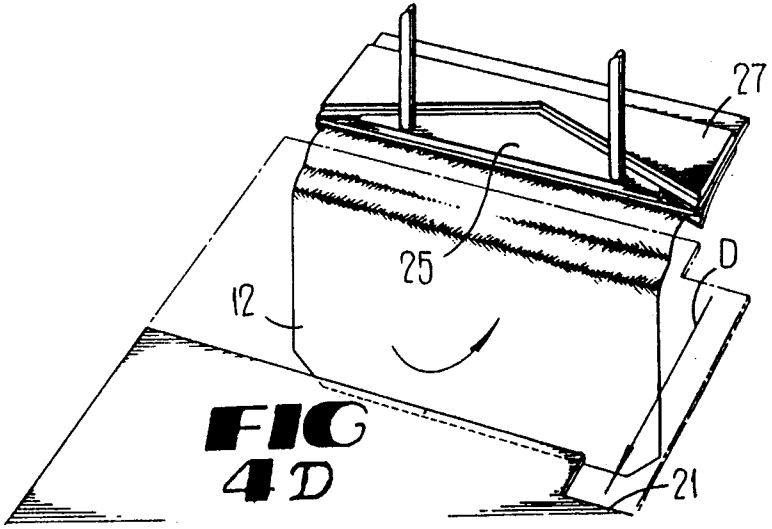
Figure 4C:
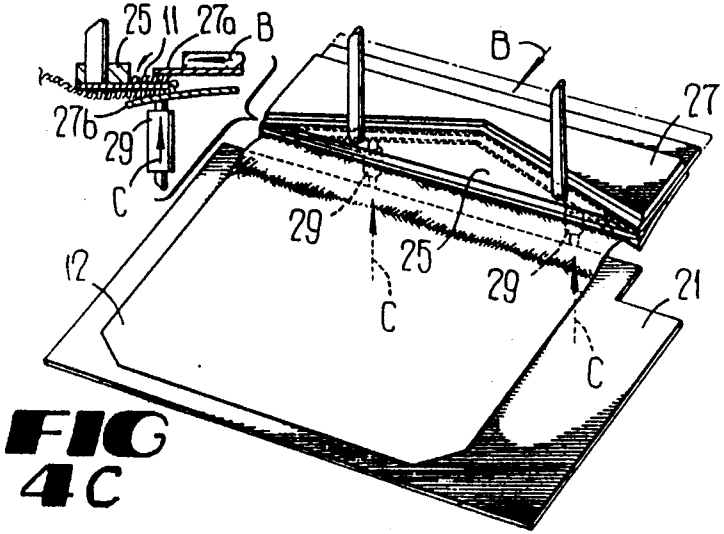

In FIG. 4D, the work plate 21, which is positioned adjacent the bottom edge of the bottom fold blade unit, then retracts in the direction of arrow D from under the ply 12, which is left dangling loosely except for the folded edge being held by the top fold blade 25, the bottom fold blade unit 27, and the bottom holding fingers 29*a*, 29*b*, . . . 29*g*.

Figure 4F:
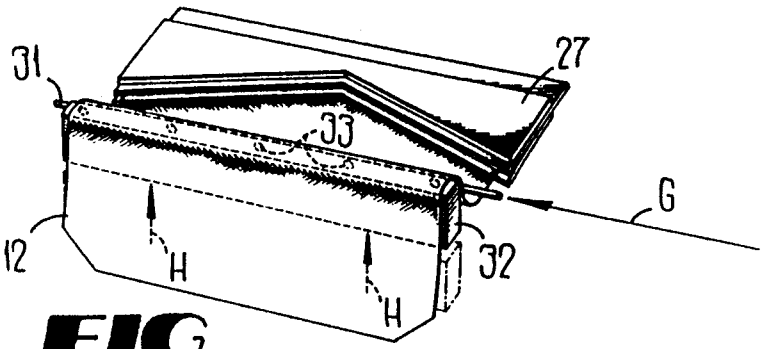
Figure 4H:
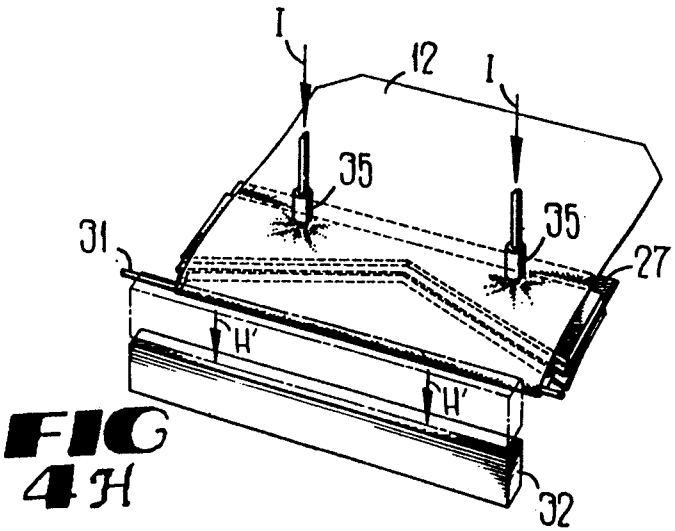
Figure 4E:
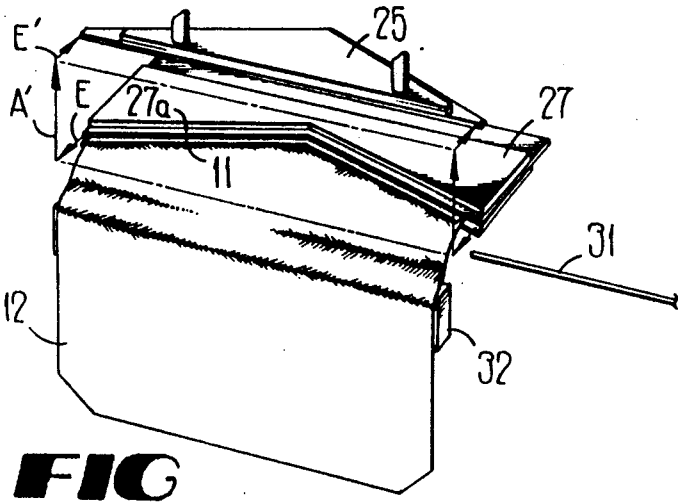

In FIG. 4E, the top fold blade 25 retracts slightly in a lateral direction E away from the bottom fold blade 27 so as to clear top 27*a* blade in the bottom fold unit 27. The top fold blade 25 then raises away from the ply of material in the direction of arrow A'. The tucked edge 11 is still held in place by the biasing action of the bottom holding fingers 29*a*, 29*b*, . . . 29*g* against the bottom fold blade unit 27.

Also in FIG. 4E, but is not illustrated, the top fold blade 25 moves to a retracted position.

In FIG. 4F, a fold-over rod 31 moves laterally in the direction of arrow G into position over the ply 12. An aluminum manifold 32 having a plurality of air jets 33 raises in the direction of arrow H under the ply 12.

Figure 4G:
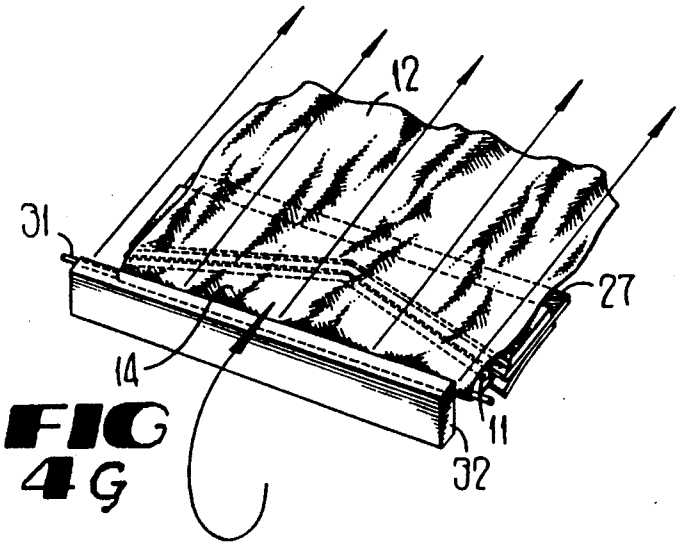

As FIG. 4G illustrates, the air jets 33 in the manifold 32 are then turned on. The force of air generated by the air jets blows the ply 12 over the fold-over rod 31. This action forms the folded upper portion 14 of the pocket. Note that the tucked edge 11 will still be held in place inside the bottom fold unit 27 by the bottom holding fingers 29*a*, 29*b*, . . . 29*g*.

A pair of top holding fingers 35 then lowers in the direction of arrow I to hold the ply and fold in place, as illustrated in FIG. 4H. The air jets 33 are turned off and the aluminum manifold 32 is lowered to its original position.

Figure 4I:
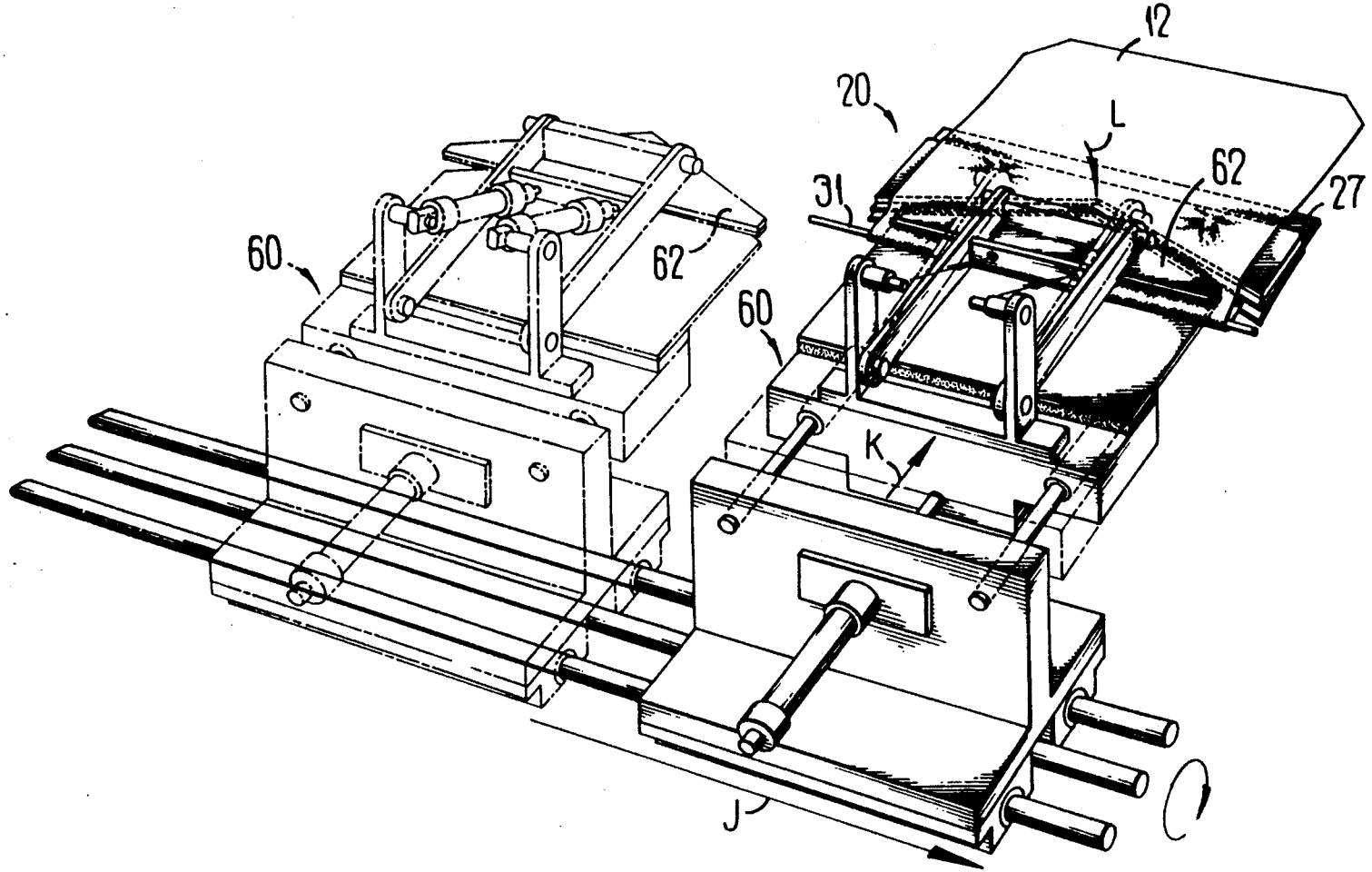

In FIG. 4I, a laterally translatable transport carriage 60 moves into the folding station 20, in the direction of arrow J. The transport carriage 60 then extends in the direction of arrow K to the now-folded and held ply 12. A clamp 62 on the transport carriage 60 closes upon the folded ply 12 in the direction of arrow L so that the fold-over rod 31 is still inside the fold between the transport carriage 60 and the clamp 62.

Figure 4J:
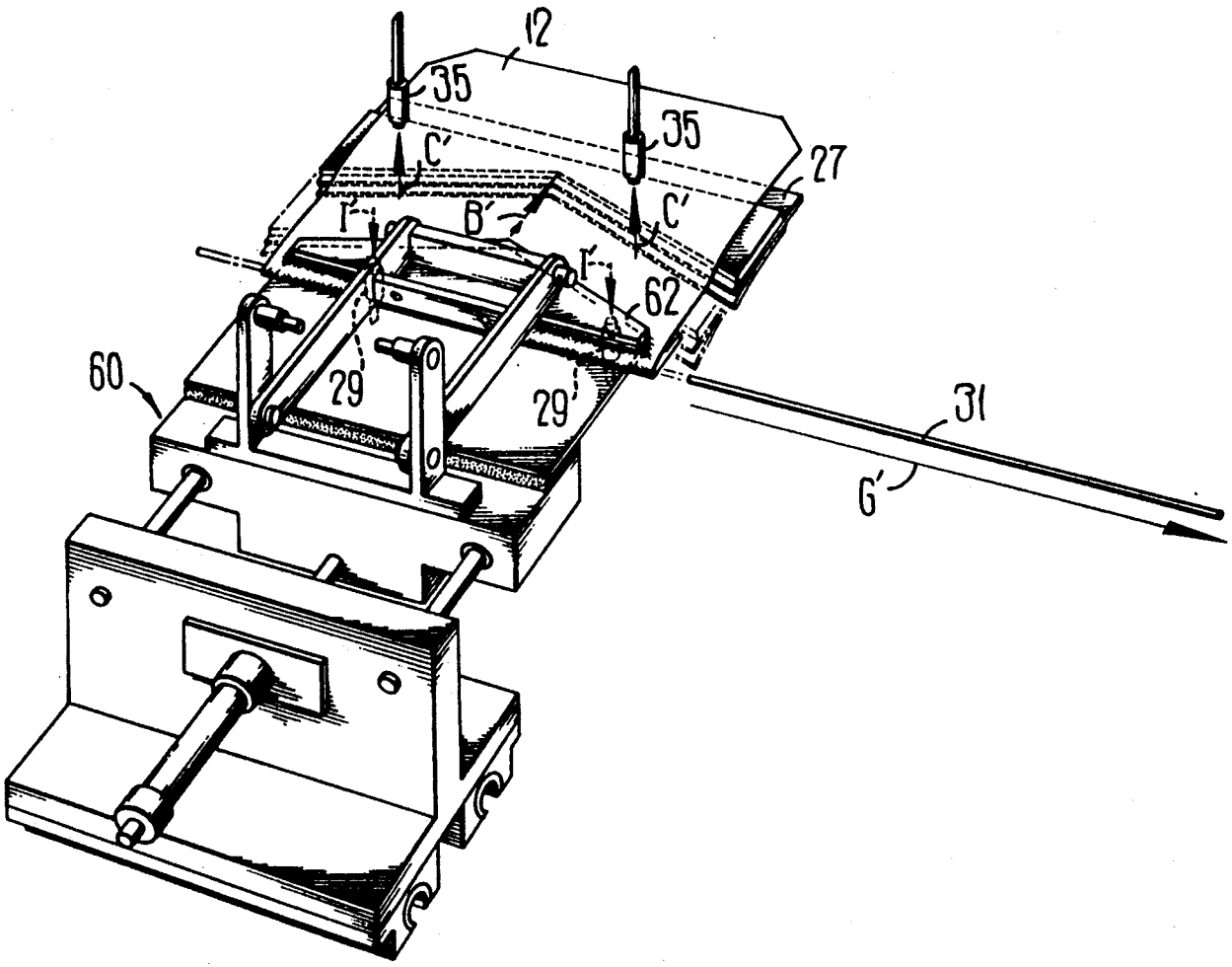

In FIG. 4J, the top hold fingers 35, the bottom hold fingers 29, and the fold-over rod 31 retract in the directions of arrows I', C', and G', respectively, leaving the folded pocket 12 held by the action of the clamp 62.

Since both the tucked edge 11 and the folded region 14 are held by the clamp 62, in FIG. 4J the bottom fold blade unit 27 completes a two-step retraction. First, the bottom fold blades 27*a*, 27*b* retract slightly and rapidly, leaving the folded edge 11 undisturbed, and then the entire bottom fold blade unit 27 retracts, leaving the ply 12 secured in the clamp 62 of the transport carriage 60. Both of these movements are in the direction of arrow B'.

Figure 4K:
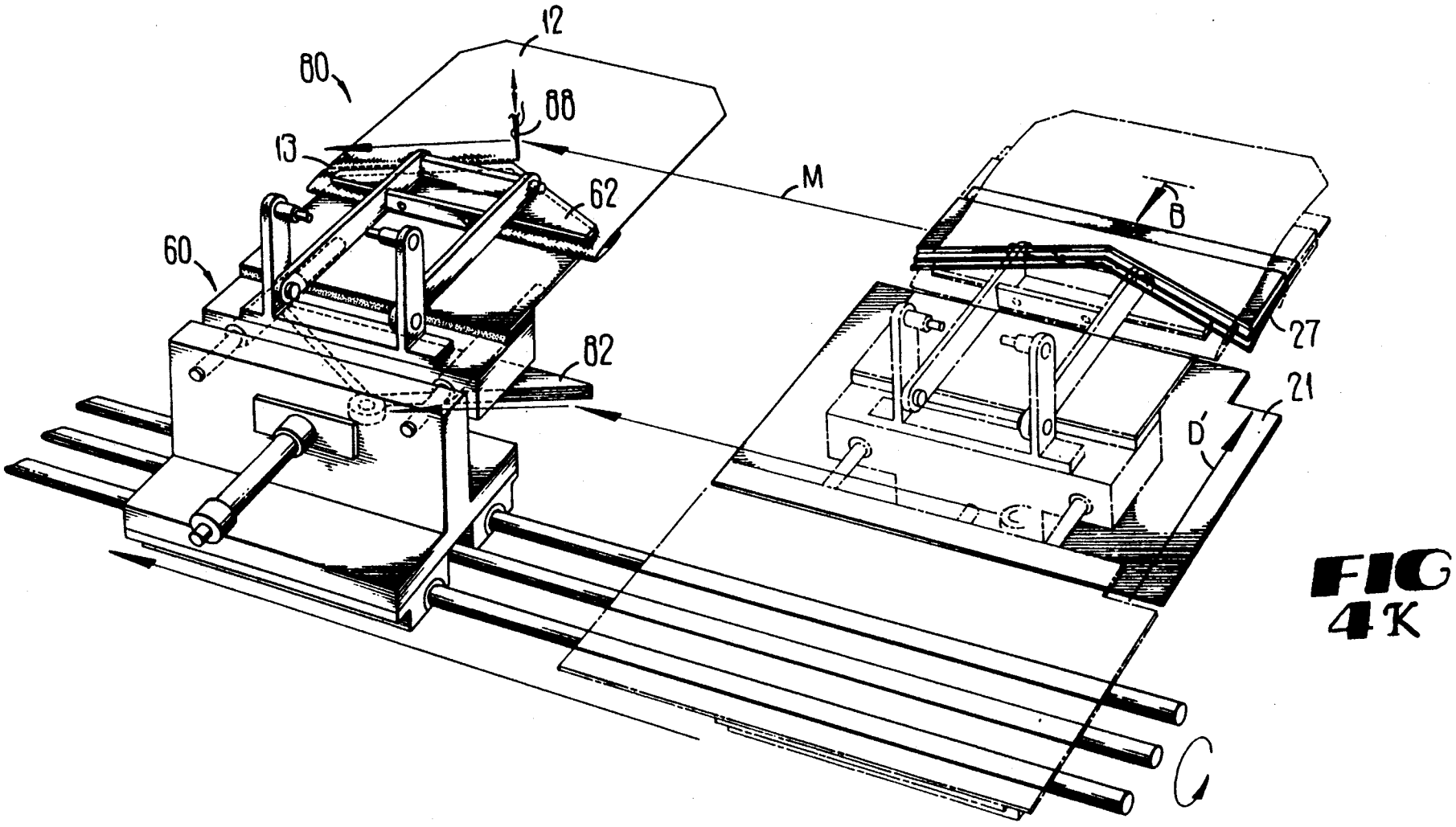

In FIG. 4K, the transport carriage 60 transports the held folded ply 12 to the sewing station 80 in the direction of arrow M. At the folding station 20, after departure of the transport carriage 60, the bottom fold blade unit 27 and the work plate 21 both return to starting positions in the directions of arrows B and D', respectively.

Figure 4L:
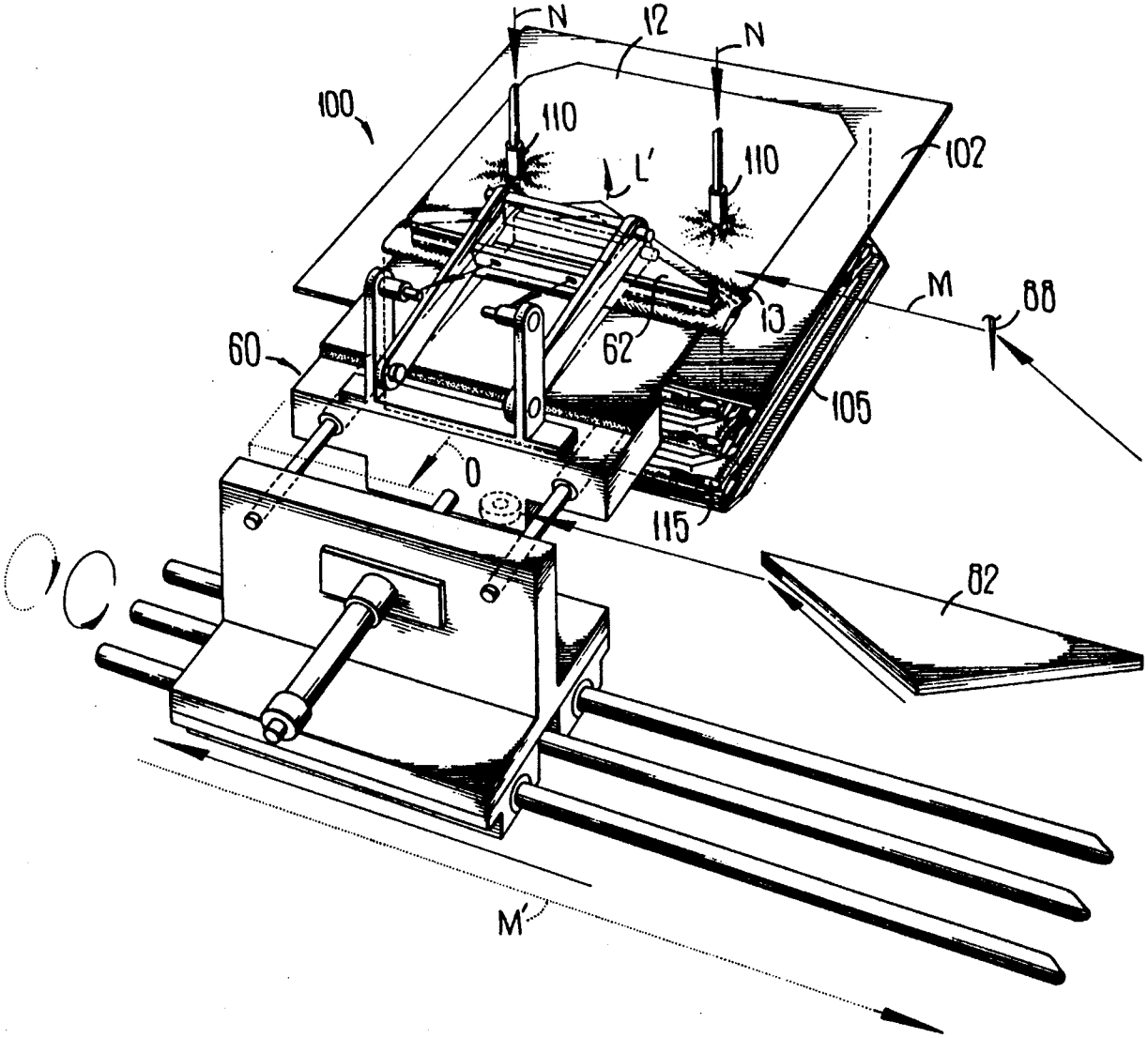

Meanwhile, back at the sewing station 80, the folded by 12 is now sewn into a V-top pocket, as seen in FIGS. 4K and 4L. Formation of the V-shaped hem 13 is completed when the transport carriage 60 transports the folded ply 12 underneath the needle 88 of the sewing machine 81. The transport carriage 60 is biased against and follows a cam 82 along a linear track which guides the folded ply 12 under the needle of the sewing machine in a generally V-shaped pattern.

Once the stitching of the pocket 12 is completed, the transport carriage 60 transports the pocket 12 to a stacking station 100, as illustrated in FIG. 4L, still in the direction of arrow M. Transport carriage stops when the stitched pocket is in place atop a stacker plate 102 in the stacking station. The stacker plate 102 is disposed directly over a stack 115 of folded, sewn pockets in a stack box 105.

At the stacking station 100, stacker hold cylinders or fingers 110 extend down in the direction of arrow N to hold the pocket 12 in place on the stacker plate 102, also at FIG. 4L. This action positively deposits the pocket onto the stacker plate 102, in that contact with the pocket is never lost. Once the stacker hold fingers 110 are holding the pocket 12, the clamp 62 opens in the direction of arrow L', releasing its grip upon the pocket 12.

Also in FIG. 4L. the transport carriage 60 then retracts along the path of arrow O, leaving the pocket 12 on top of the stacker plate 102. Once the transport carriage 60 is retracted away from the pocket, the transport carriage 60 returns along the path of arrow M' to its initial position immediately next to the folding station 20.

Figure 4N:
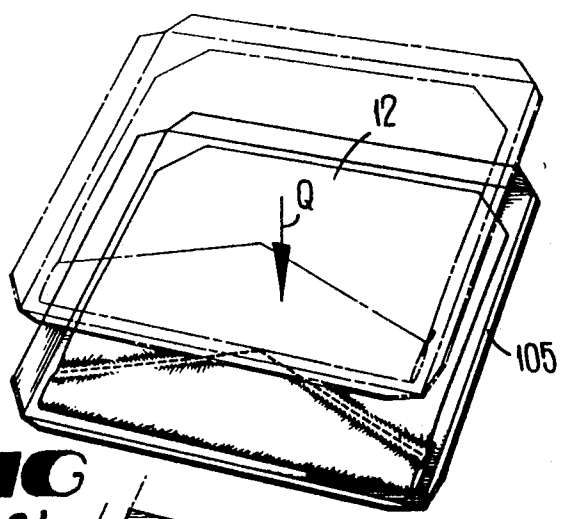
Figure 4P:
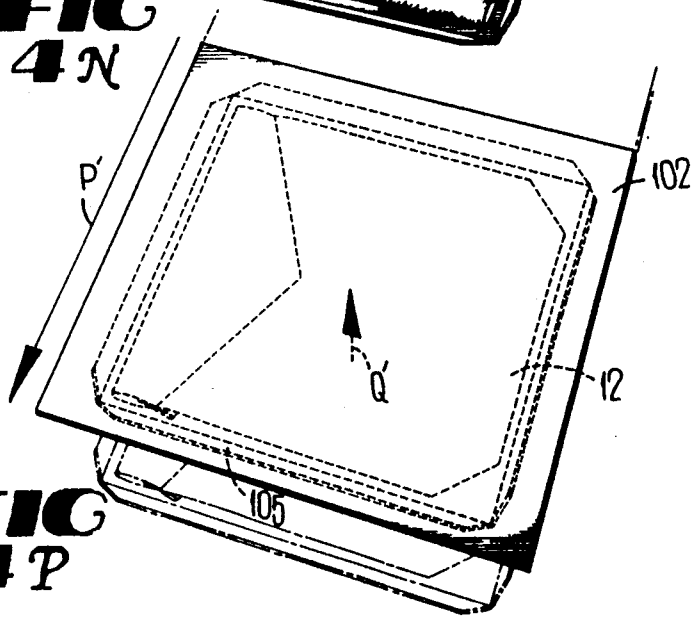
Figure 4M:
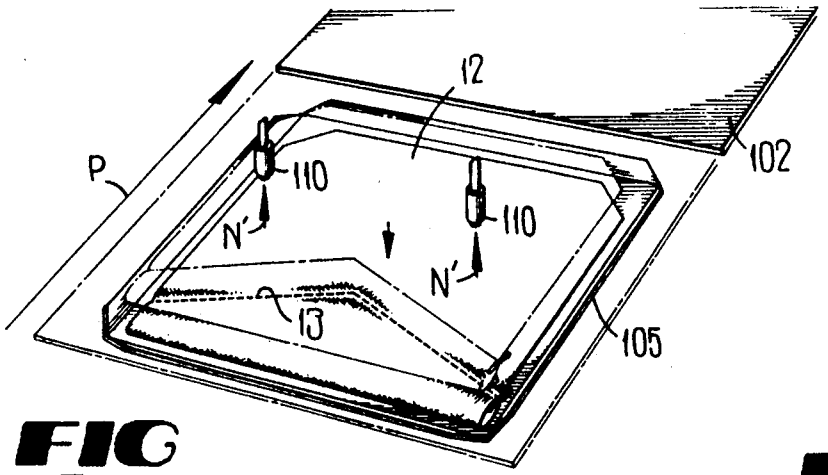

In FIG. 4M, the stacker plate 102 retracts in the direction of arrow P, sliding out from under the pocket 12, while the pocket is held by the stacker hold fingers 110, causing the pocket to be deposited upon the top of the stack of pockets 115 in a stack box 105. The stacker hold fingers 110 positively bias the pocket downwardly as the stacker plate slides out from under the pocket. Again, this action comprises a positive depositing action.

Once the pocket 12 is on the stack box 105, the stacker hold fingers 110 retract upwardly in the direction of arrow N', as shown in FIG. 4M.

In FIG. 4N, the stack box 105 moves in a downward direction Q so that the top of the stack is approximately two to three inches below the path of travel of the stacker plate 102, to provide clearance for return of the stacker plate. As the stack grows, the stack box 105 descends lower and lower to provide clearance for the return of the stacker plate. When the stack is full, a proximity detector 120 (FIG. 10) detects the approach of the bottom of the stack box 105 and generates an alarm, informing the operator of the need to empty the stack box 105.

Figure 4O:
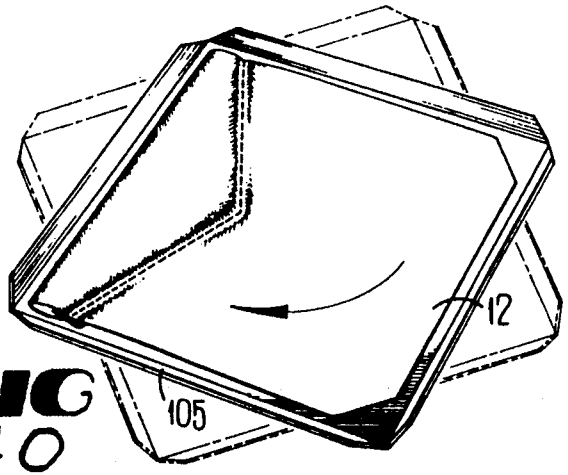

In FIG. 4O, the stack box 105 rotates 90° degrees so as to distribute the build up in height due to the sewn pockets and ensure a neat, centered stack.

In FIG. 4P the stacker plate 102 extends in the direction of arrow P' back over the top of the stack box 105, where the stacker plate 102 awaits the arrival of the next pocket 12 from the sewing station. The stack box 105 also moves in an upward direction Q' until the top of the stack of pockets 115 is directly under the stacker plate 102. An electric eye (not shown) detects the top of the stack 115 and sends a signal to the controller 8 which halts the upward movement of the stack box 105 a predetermined distance away from the bottom surface of the stacker plate 102.

Figure 5:
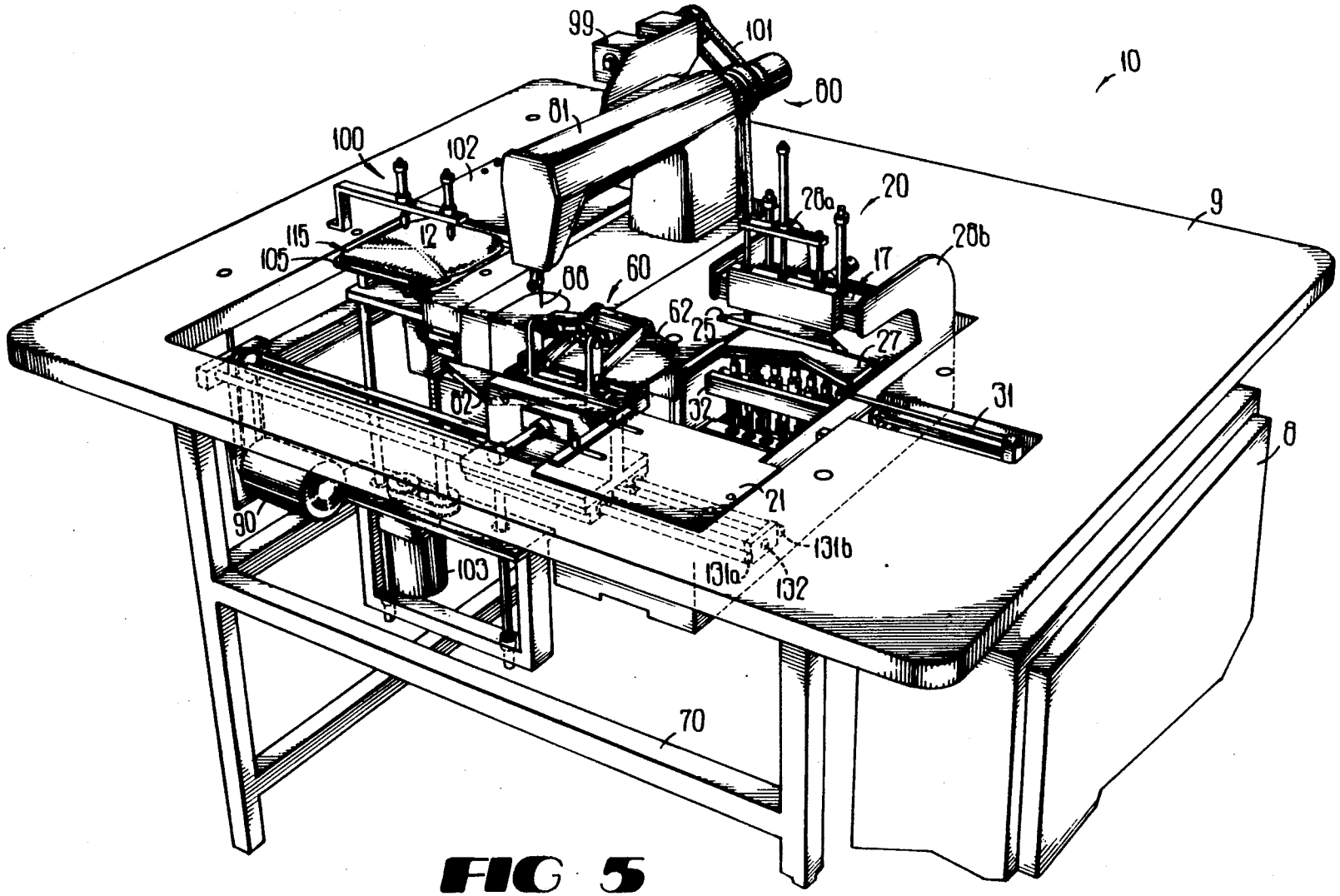
FIG. 5 is a perspective pictorial view of the preferred embodiment of a ply folding, sewing, and stacking apparatus constructed in accordance with the present invention.

Referring now to FIG. 5, it may be seen that the preferred embodiment of the ply folding and sewing apparatus 10 constructed in accordance with the present invention, for carrying out the above-described method, comprises a folding station 20, a sewing station 80, a stacking station 100, and a transport carriage 60 for transporting plies from the folding station 20, through the sewing station 85, and to the stacking station 100. The entire assembly is mounted within a tubular metal frame 70, with the folding station 20 at one end, the sewing station 80 positioned in the center of the frame, and the stacking station 100 positioned toward the other end of the frame.

The transport carriage 60 moves essentially in a linear, lateral manner between the various workstations, except for the biasing action against the pattern to form the V-shaped hem. A pair of parallel support rods 131*a*, 131*b* support the carriage 60 for lateral movement. A rotating drive rod 132 which is driven by a belt drive and a stepper motor 90 provides rotary motion for moving the carriage. The rotary motion is turned into lateral motion with a Roh'lix threadless mechanical screw-type linear actuator 124, manufactured by Zero-Max, a unit of Barry Wright, Minneapolis, Minn. Details of the preferred linear actuator are available in the technical literature supplied by the manufacturer.

The speed of the transport carriage 60 is controlled by the stepping motor 90. As will be understood by those skilled in the art, the stepping motor is driven by drive pulses from a power amplifier circuit board (not shown), which receives input pulses from the controller 8. The controller 8 provides input pulses to the power amplifier to control the speed and direction of rotation of the stepping motor.

For movement of the transport carriage from the folding station 20 to the sewing station 80, the controller 8 provides pulses to the power amplifier to drive the stepping motor 90 at a high slew rate. Acceleration and deceleration are provided in the known manner. Upon arrival at the sewing station 80, as detected by the actuation of a limit switch (not shown) connected to the controller 8, the sewing machine's motor 98 controls the speed with which the stepping motor 90 transports the transport carriage under the needle 88 of the sewing machine 81. The speed of rotation of the sewing machine motor is detected with an encoder 99, which is coupled with a belt drive 101 to the motor 98. Signals from the encoder 99 are provided to the controller 8, which shifts the stepper motor 90 to a slower stitch rate of movement of the carriage through the sewing station in synchronization with the stitching of the sewing machine. The operator can select 12, 16, or 18 stitches per inch at the sewing machine. These settings are provided to the controller 8.

Movement of the transport carriage 60 out of the sewing station 80 to the stacking station 100, as well as return movement from the stacking station 80 back to the folding station 20, is at a high slew rate.

Figure 6:
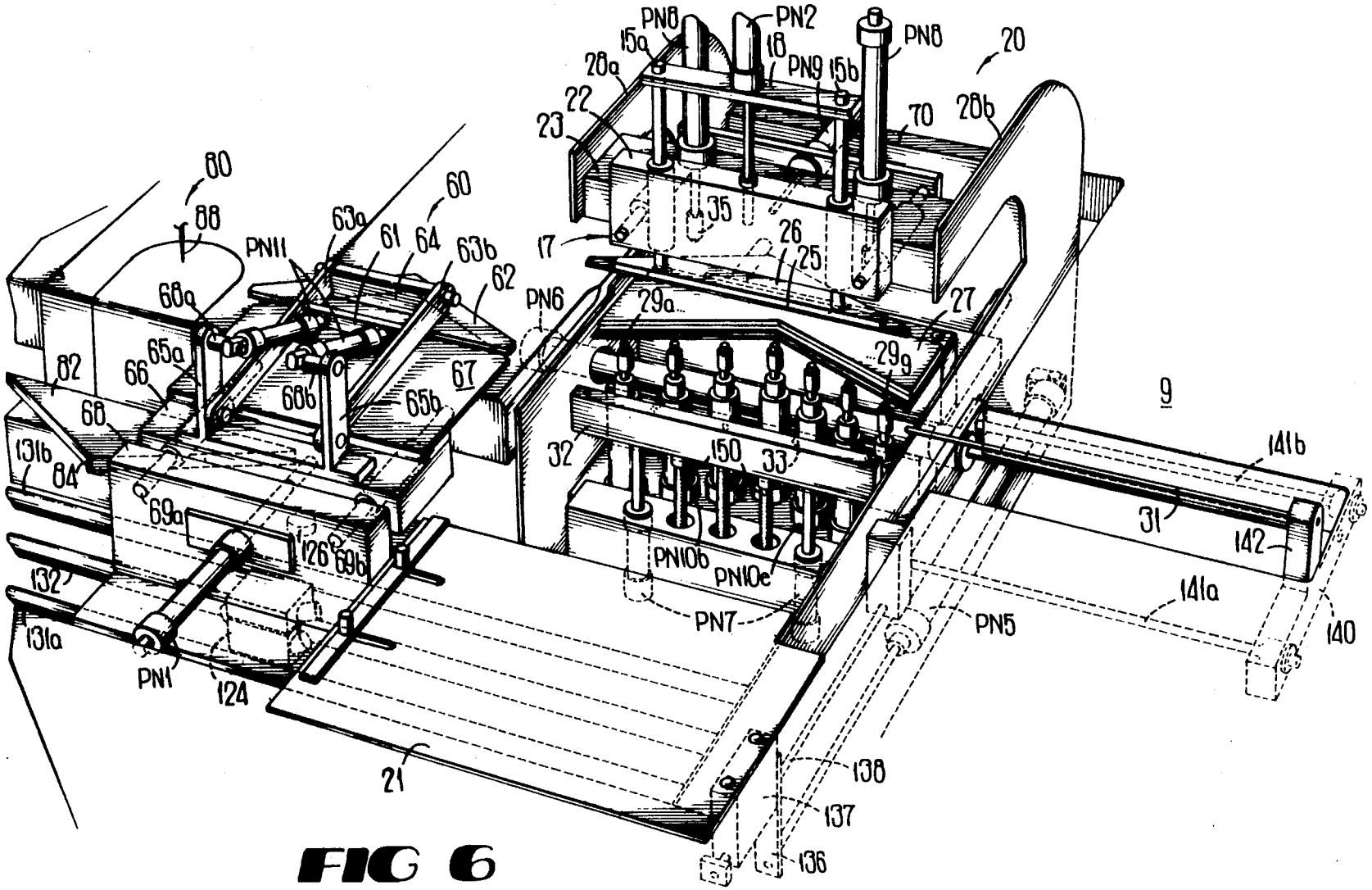
FIG. 6 is a perspective detailed pictorial view of the folding station and transport carriage employed in the preferred embodiment of FIG. 5.

Referring next to FIG. 6, as the transport carriage 60 transports the folded ply 12 under the needle 88 of the sewing machine 81, air pressure in a pneumatic cylinder PN1 biases the carriage against a patterned cam 82, which in the preferred embodiment is a triangular cam for making the V-shaped pattern. However, it will be appreciated that other decorative patterns could be employed, and those skilled in the art will understand that cams having patterns such as wavy lines, curves, zig-zags, etc. can easily be employed by substituting an appropriately-shaped cam for the cam 82.

A center detector 45 (FIG.9) comprising a limit switch detects when the center point or apex of the V-shaped hem 13 has been reached during the sewing, by detecting when the transport carriage passes the center of the cam 82. A control signal from the center detector 45 is provided to the controller 8. At the center point, the stepping motor 90 is stopped momentarily so as to avoid over-or under-stitching of the apex of the V-shaped hem. The direction of the ply 12 under the needle 88 of the sewing machine 81 then changes by virtue of the fact that a cam follower 126 passes over the apex 84 of the triangular cam 82, seen best in FIG. 6. The stepping motor 90 is then restarted so as to transport the ply 12 under the needle of the sewing machine for stitching of the second half of the V-shaped hem 13.

After stitching of the folded ply 12, the stepping motor 90 is controlled to transport the folded sewn ply 12 to the stacking station 100 at a slew rate. At the stacking station 100, an electric motor 103 is employed to move the stack box 105 down two to three inches each time a new ply is added to the top of the stack and to move the stack box 105 up to its position just underneath the stacker plate 102.

Still referring to FIG. 6, a precut, unfolded, unsewn ply of material is supplied by an operator, who manually places the ply on the work plate 21. After the operator depresses a start button (not illustrated), the top fold blade 25 lowers upon the ply 12. The top fold blade 25 is a generally triangular shaped piece of metal which is attached to a slightly smaller triangular shaped piece mounting plate 26 by screws or bolts. The mounting plate 26 is supported over the work plate 21 by a mounting block 22, which is secured to a rectangular three-dimensional securing block 23. The securing block 23 is suspended by two generally flat, parallel, J-shaped support plates 28*a*, 28*b*, which are fastened to the metal frame 70.

Two support rods 15*a*, 15*b* are mounted for vertical movement in corresponding bushings 16*a*, 16*b* within the securing block 23. The upper ends of the support rods 15 are affixed to a horizontal support plate 18, a rectangular shaped strip of metal which is bolted at the ends to each of the support rods 15*a*, 15*b*. At the center of the support plate 18 is mounted a pneumatic cylinder PN2. The end of the actuator rod of the pneumatic cylinder PN2 is attached to the mounting block 22. The top fold blade 25 is movable in the direction of arrow A by the pneumatic cylinder PN2, and such movement allows the top folding blade 25 to be lowered upon the precut ply of material 12 in a manner that leaves a generally V-shaped edge of material 12*a* which will be folded in such a manner so as to create a V-top pocket.

Figure 7:
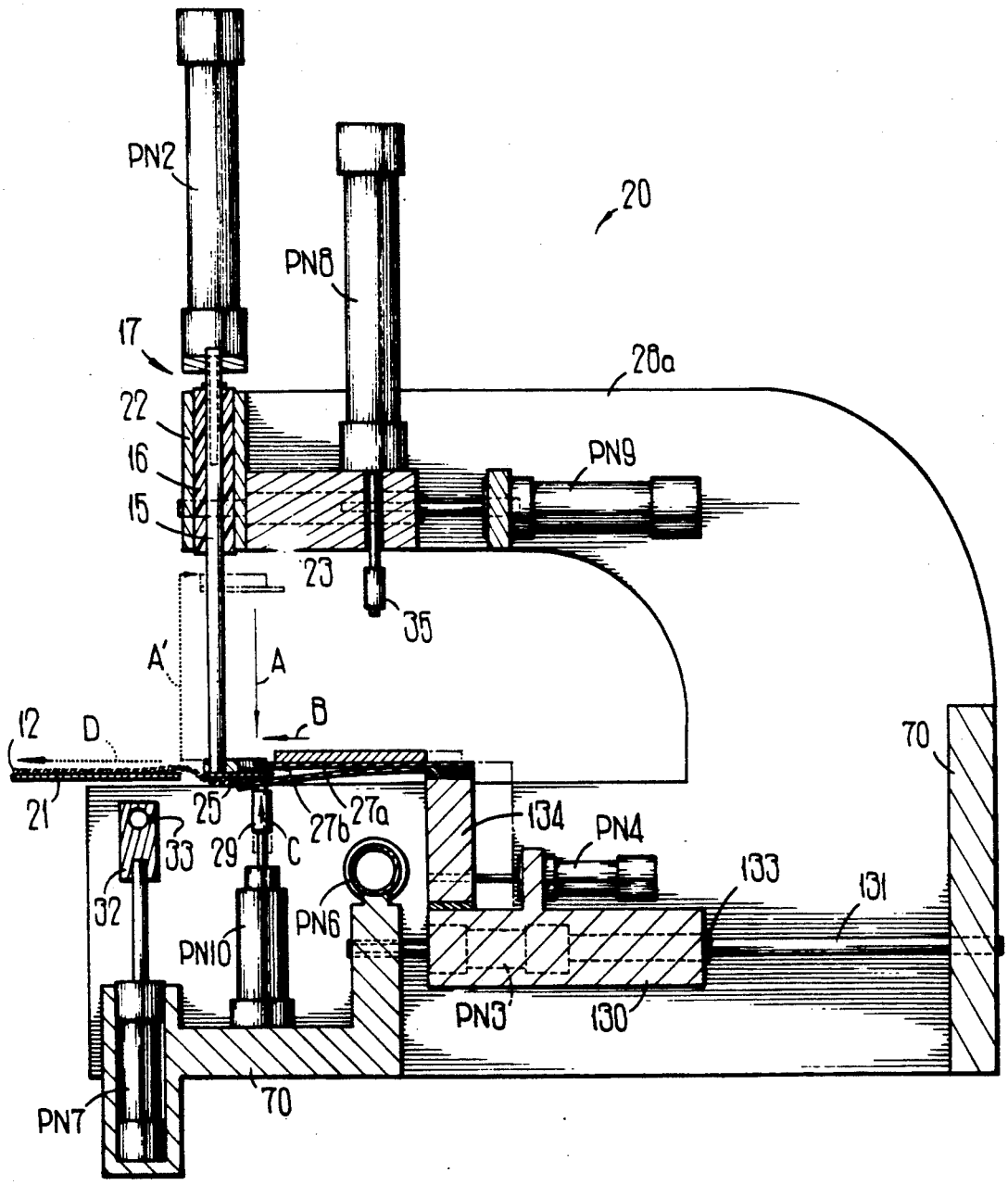
FIG. 7 is a partial, side sectional view of the folding station employed in the preferred embodiment of FIG. 5.

A retractable top fold blade assembly 17, seen in FIG. 7, comprising top folding blade 25, mounting block 22, cylinder PN2, support rods 15, and bushings 16 is laterally translatable or retractable by a pneumatic cylinder PN9. The cylinder PN9 is affixed to the securing block 23, with its actuator rod terminating on the mounting block 22.

Figure 9:
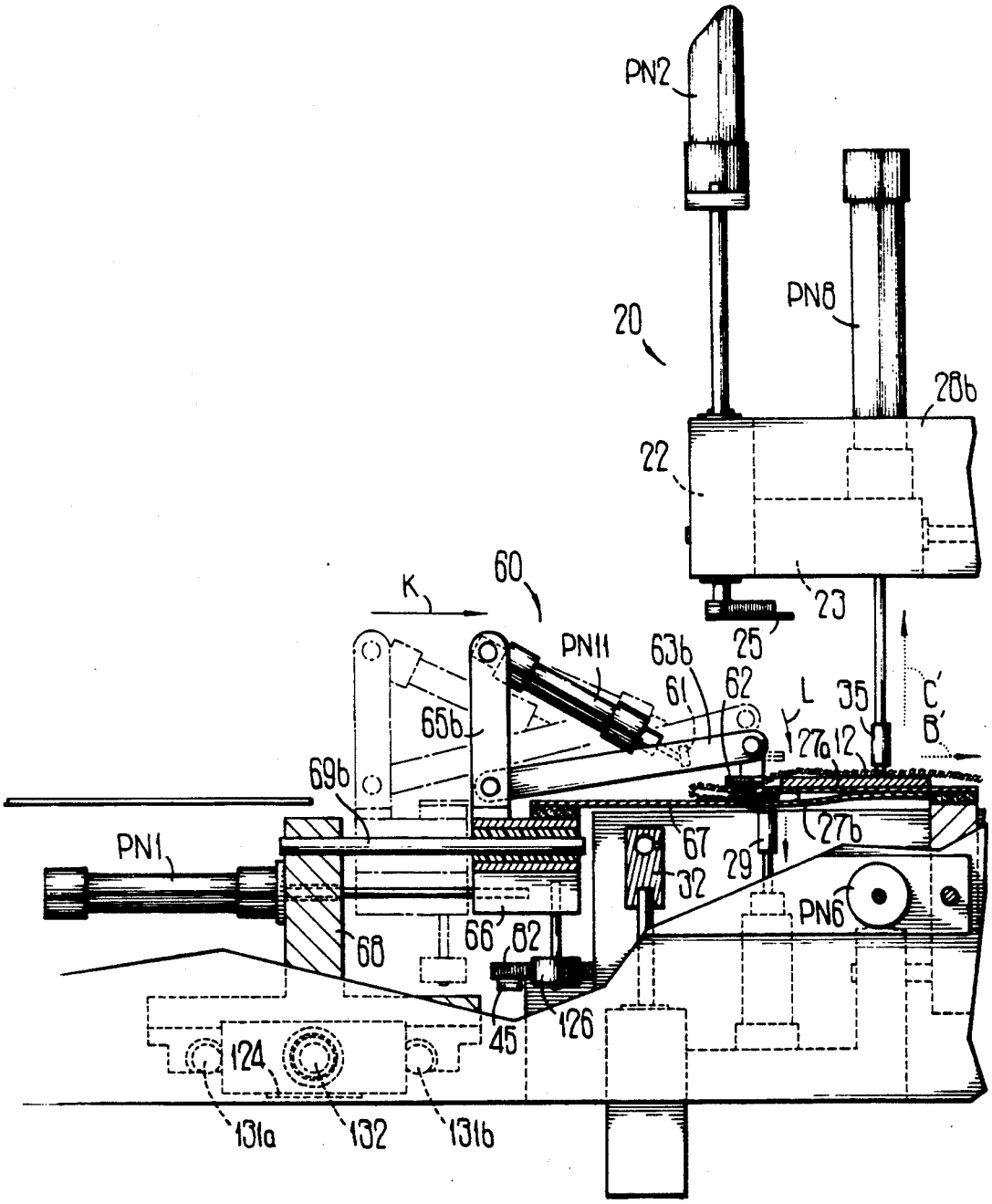
FIG. 9 is a partial side sectional view of the transport carriage and folding station employed in the preferred embodiment of FIG. 5.

Still referring to FIG. 6, the bottom fold blade unit 27 comprises a two-layer assembly of generally rectangular pieces of spring steel, with a top blade 27*a* and a bottom blade 27*b*. The blade unit 27 forms a V-shaped edge folding boundary along the front edge (toward the plate 21), with the top blade 27*a* being slightly set back with respect to the bottom blade 27*b*, as best seen in FIGS. 7 and 9, and in FIGS. 4C and 4D

Referring now to FIG. 7, the bottom fold blade unit 27 is attached to a mounting block 130, which is supported for movement in the direction of arrow B. A guide and support rod 131 is mounted to the frame 70, so that the unit 27 slides on bushings 133. A horizontally mounted pneumatic cylinder PN3 moves the block 130 between a first, forward position in engagement with the ply of material (as shown in FIG. 7) and a second, retracted position.

The actual folding or tucking of the edge of the ply of material is the responsibility of a pneumatic cylinder PN4, which is mounted to the mounting block 130. The actuator rod the cylinder PN4 slides a secondary mounting block 134 between a first, retracted position (shown in phantom in FIG. 7) and a second, forward position (as seen in FIG. 7) in engagement with the edge of the ply.

It will thus be appreciated that the pneumatic cylinder PN3 moves the entire bottom fold blade unit 27 into position for folding the edge and retracts the unit to release the folded ply, while the pneumatic cylinder PN4 only moves the top and bottom blade 27*a*, 27*b* a small distance sufficient to cause the folding or tucking of the edge of the material around the top fold blade 25.

Referring again to FIG. 6, it will be seen that the work plate 21 is retractable in the direction of arrow D, by a pneumatic cylinder PN5 which is mounted to the frame 70 underneath the fold unit 20. The actuator rod of the cylinder PN5 is affixed to a vertical plate 136 which in turn is affixed to a support block 137. The work plate 21 rests upon the support block 137. A guide rod 138 is received within the support block 137 and is mounted at each end to the frame 70.

The fold-over rod 31 is movable into position adjacent the bottom fold unit 27 with a pneumatic cylinder PN6. The cylinder PN6 is mounted horizontally in the frame 70 beneath the fold unit 20, and the actuator rod is affixed to a fold-over rod support block 140. The fold-over rod support block 140 is supported for movement by a pair of guide and support rods 141*a*, 141*b*, which are supported by bushings in the frame 70. A fold-over rod support 142 holds one end of the fold-over rod 31 in a cantilever fashion in the work area of the fold unit 20. The fold-over rod 31 itself is a thin metal rod. The other end of the fold-over rod 31 is unsupported.

As will be recalled from the discussion above concerning the method of operation of the preferred embodiment, once the fold-over rod 31 is in position over the dangling ply of material 12, an aluminum manifold 32 is raised underneath the ply 12 by two pneumatic cylinders PN7, which are mounted to the frame 70. The air jets 33 within the manifold 32 are supplied by air hoses 150, which blow the dangling end of the ply 12 over the fold-over rod 31, as best illustrated in FIG. 4.

After folding of the ply 12 over the fold-over rod 31, the top holding cylinders PN8, which are pneumatic cylinders with nylon or rubber tips or fingers 35 affixed to the ends of the actuator rods, descend upon the ply 12 and hold the now-folded ply 12 in place. The top holding cylinders PN8 are mounted to the securing block 23, as best seen in FIG. 7.

The bottom holding fingers 29*a*, 29*b*, . . . 29*g* are moved into place against the bottom fold blade 27*b*, as best seen in FIG. 7, by seven pneumatic cylinders PN10, one for each of the bottom holding fingers 29*a*, 29*b*, . . . 29*g*. The pneumatic cylinders PN10 are mounted vertically in the frame 70. The bottom holding fingers 29*a*, 29*b*, . . . 29*g* press against the bottom fold blade 27*b*, which will have the edge-tucked ply in place, to hold the edge tuck in place.

As will be recalled from the discussion above about the preferred method of the present invention, the transport carriage 60 moves into position in the folding station 20 so as to transport the folded ply 12 from the folding station 20 through the sewing station 80 and to the stacking station 100. Still referring to FIG. 6, the transport carriage 60 comprises a triangular shaped clamp 62, the top surface of which is secured to a pivotable support member 64. The support member 64 is pivotably mounted via an anxle to the ends of a pair of support arms 63*a*, 63*b*. The opposite ends of the support arms 63*a*, 63*b* are in turn pivotably mounted to the lower portion of a pair of upright supports 65*a*, 65*b*, both of which extend upward from a mounting block 66.

The clamp 62 is moves into its clamped position under the influence of a pair of pneumatic clamping cylinders PN11. The cylinders PN11 are pivotably attached to the upper ends of the upright supports 65*a*, 65*b*. The actuator arms of the cylinders PN11 are pivotably attached to a bridging strut 61. Actuation of the cylinders PN11 forces the clamp 62 downward and onto a clamping plate 67. The clamping plate 67 is affixed to the mounting block 66. The folded ply of material is thereby firmly held in place between the clamp 62 and clamping plate 67.

Referring to FIG. 9, the mounting block 66 itself is supported for lateral movement in the direction of arrow K. The cam follower 126 hangs downwardly from the mounting block 66 where it can contact the pattern cam 82. A pair of parallel support rods 69*a*, 69*b* are affixed at one end to a carriage block 68, and at the other end to the mounting block 66. Pneumatic cylinder PN1 moves the support block 66.

The lower portion of the carriage block 68 includes the Roh'lix drive system 124 which is driven by the drive rod 132, and the entire carriage block 68 slidably rests and is supported by the guide rods 131*a*, 131*b*.

Referring back again to FIG. 5, the motor 90 in the preferred embodiment is a bidirectional stepping motor, mounted to the frame 70, which is controlled by a power amplifier circuit (not illustrated) associated with the controller 8. The power amplifier circuit receives pulses or drive signals from the programmable controller 8 and is operative to accelerate the carriage 60, slew, decelerate, and stop. At the sewing station, pulses from the encoders 99 synchronized with the sewing machine are provided to the controller, which then provides synchronized drive pulses to the motor 90 so that the carriage 60 is carried through the sewing operation in synchronization with the sewing.

Once grasped between the clamp 62 and the clamping plate 67, a folded ply is now ready to be transported through the sewing station 80 for stitching of the V-shaped hem. Once the ply 12 is secured by the clamp 62, the top holding fingers 35, the bottom hold fingers 29, and the fold-over rod 31 retract to their original positions, as described above, and the ply can be removed from the folding station 20. As will be recalled from the discussion above, the transport carriage 60 carries the folded ply through the sewing station, in synchronization with the sewing machine, and biased against the pattern cam 82 to form the patterned hem.

Figure 8:
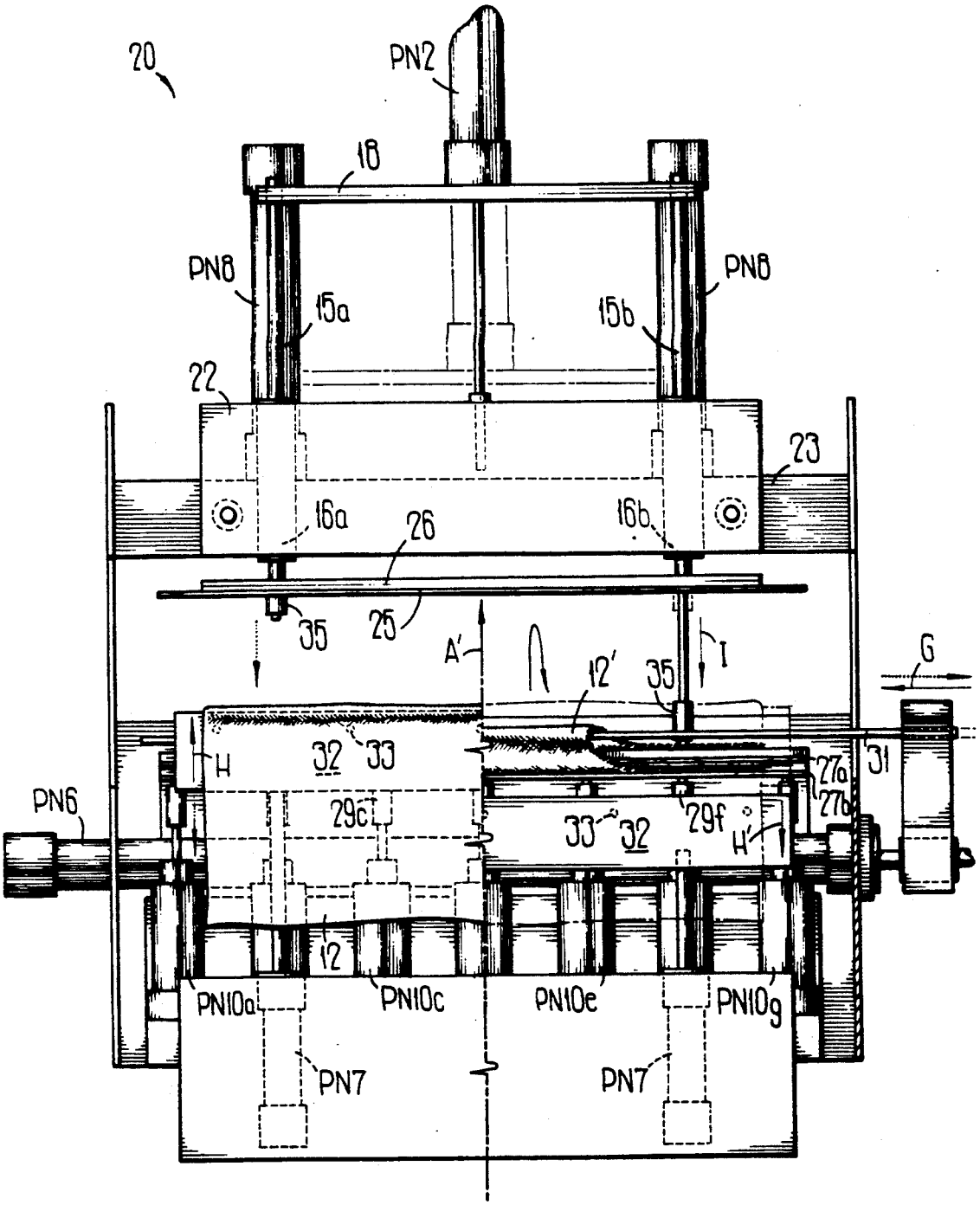
FIG. 8 is a front view of the folding station employed in the preferred embodiment of FIG. 5.

FIG. 8 presents side-by-side partial views of the operation of the folding station 20 before and after the raising of the aluminum manifold 32, the activating of the air jets 33, and the lowering of the top holding fingers 35. Prior to these actions, the unfolded ply of material 12 dangles loosely, held at one end by the top fold blade unit 25 and the bottom fold blade unit 27. After the fold-over rod 31 is moved into position over the ply of material 12, the aluminum manifold 32 is raised by the cylinders PN7 to just over the fold-over rod 31 and ply of material 12. Upon activation, the air jets 33 blow air onto the dangling ply of material 12, forcing the loose end of the ply over the fold-over rod 31. Once the folded ply 12' is folded over the fold-over rod 31, the top holding fingers 35 extend down from their position above the ply 12, holding the ply 12 securely.

Figure 10:
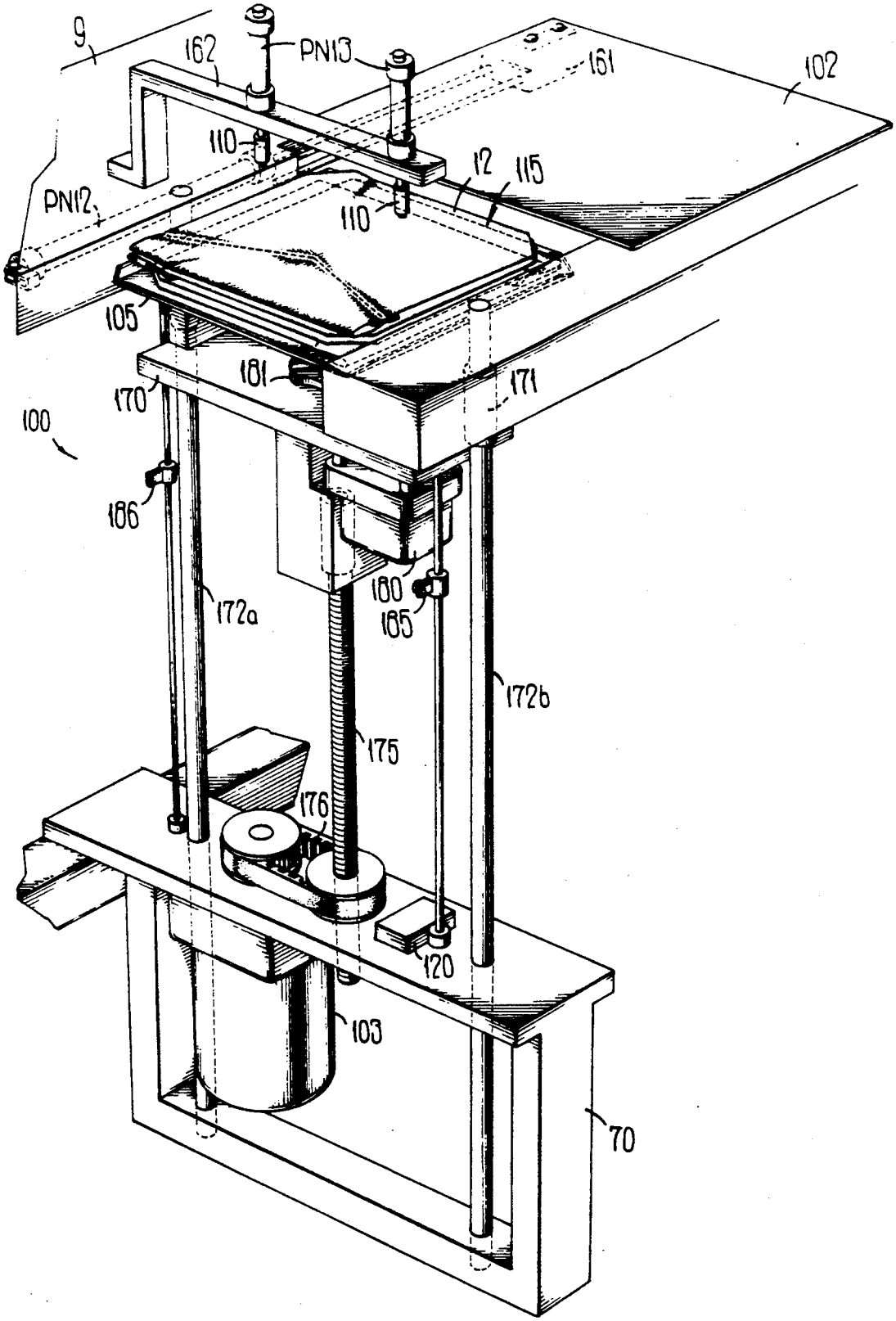
FIG. 10 is a partial perspective view of the stacking station employed in the preferred embodiment of FIG. 5.

Turning now to FIG. 10, next will be described the structure and operation of the stacking station 100 employed in the preferred embodiment. The stacking station 100 includes a rotatable stack box or stacking surface 102 upon which the stack of plies 115 is built.

A ply is delivered by the transport carriage 60 (not shown in FIG. 10) to rest atop the stacker plate 102, which is shown in the retracted or second position in FIG. 10. The stacker plate 102 is moved between its home position over the stack of pockets 115 and its second position with a pneumatic cylinder PN12, which is mounted for horizontal movement on the frame 70. The actuator rod of the cylinder PN12 is connected to a drive block 161, which in turn is attached to the stacker plate 102.

The stacker hold fingers 110, made of a tacky material such as nylon or rubber for frictional engagement with the pocket, are powered by pneumatic cylinders PN13, which are suspended for vertical movement over the stack of plies 115 with a cantilevered support bracket 162. The support bracket 162 is mounted at one end to the table top 9. The pneumatic cylinders PN13 press the stacker hold fingers 110 against a delivered pocket when it is deposited on the stacker plate 102. The bias of the cylinders PN13 is held while the stacker plate 102 retracts, to positively deposit the pocket on top of the stack of pockets 115.

The stack box 102 is supported for rotatable movement on a stack box mounting shelf 170. The shelf 170 is supported for vertical movement at sleeves 171, which receive vertical guide rods 172*a*, 172*b*. A ball screw drive rod 175 is driven by a belt 176 connected to electric motor 103, which is mounted to the frame 70. Rotation of the drive rod 175 raises and lowers the shelf 170, depending upon the direction of rotation of the motor 103.

The stack box 105 is rotated in ninety-degree increments by an electric motor 180, which is connected to a cam-driven rotator mechanism 181. The rotator mechanism 181 is a conventional rotator, Geneva Mechanism model #EAS-A1-1, manufactured by Nordex Inc., Danbury, Conn., the details of which are available in the literature supplied by the manufacturer. A control signal from the controller 8 causes the motor 180 to activate and rotate the stack box 105 ninety degrees for each ply stacked.

The extent to which the stack box is lowered is determined by the need to return the stacker plate 102 to its home position disposed over the stack box 105 after a stacking cycle. The stack box is lowered until the top of the stack is detected by an electric eye 185. A reflective foil 186 is positioned opposite the electric eye 185 so that when the top of the stack clears the foil 186, the electric eye detects the foil and sends a signal to the controller 8 that the stack has been sufficiently lowered. The controller can then begin to raise the stack again and restore the stacker plate 102 to its home position.

A proximity detector 120 is mounted on the frame 70 near the electric motor 103 and belt drive 176, for detecting the approach of the stack box 105. As the stack 115 grows larger and larger, the stack box 105 must be lowered more and more for the top of the stack to clear the electric eye 185. When the proximity detector 120 detects the near presence of the stack box 105, it sends a signal to the controller 8, which then generates a "stack full" message to an operator. An operator must then come and remove the stack of folded, sewn pockets. The stack full message also prevents further cycles of the machine until the stack is cleared.

It will by now be appreciated that there has been described an apparatus and method for forming a folded, sewn ply of material such as a V-top pocket, wherein the manipulated edge, having a tucked edge, is positively held at all times during movement of the ply from one workstation to another. It will also be appreciated that the folded ply is always positively held by the clamp 62 after the fold and edge tuck are formed, from retrieval from the folding station, to and through the sewing station, and to the stacking station, so that risk of loss of the folded edge, of misaligned sewing, or of misaligned stacking, is minimized.

Accordingly, it will be understood that the preferred embodiment of the present invention has been disclosed by way of example and that other modifications and alterations may occur to those skilled in the art without departing from the scope and spirit of the appended claims.

What is claimed is:

1. Apparatus for sewing a ply of material along a predetermined seam pathway, comprising:

alignment means for receiving a ply of material in an aligned manner;

clamping means for clamping and holding the ply at said alignment means while leaving a sewing region exposed for sewing;

carriage means for moving said clamping means from said alignment means through a sewing machine to stitch the ply along said sewing region, and for moving said clamping means from said sewing machine to a final work station after completion of the stitch;

a sewing machine:

means for biasing said clamping means against a pattern cam to impart a pattern in the path of the seam made by said sewing machine;

detecting means for detecting the speed of movement of a component of said sewing machine associated with the movement of a needle operated by said sewing machine, and for providing a sewing speed signal corresponding to said speed of movement; and synchronizing means for synchronizing the movement of said carriage means through said sewing machine during sewing, said synchronizing means being responsive to said sewing speed signal.

2. The apparatus of claim 1, wherein said carriage means is operative to move at a slew rate from said alignment means to said sewing machine, at a synchronized rate determined by said synchronizing means during sewing, and at a slew rate from said sewing machine to said final work station.

3. The apparatus of claim 1, wherein said clamping means comprises a top clamping member and a bottom clamping member, and further comprising means for extending said clamping means from a first retracted position to a second extended position wherein said top clamping member and said bottom clamping member extend into said alignment means while leaving said sewing region exposed, and means for closing said top clamping member onto said bottom clamping member to clamp the ply.

4. The apparatus of claim 1, further comprising folding means operatively associated with said alignment means for forming a folded ply of material, and wherein said clamping means is operative to clamp the folded ply after said folding means has folded the ply and to hold the fold in the ply during sewing.

5. The apparatus of claim 1, wherein said final work station comprises a stacking station for stacking a plurality of sewn plies.

6. An apparatus for forming a folded pocket ply of material, having a generally V-shaped seam, comprising:

means for aligning a ply having a V-shaped leading edge;

edge folding means for folding the V-shaped leading edge to form a V-shaped tucked edge holding means for holding the tucked edge;

means for folding the material to form a folded region while said holding means holds the tucked edge;

means for sewing said folded region through the tucked edge to form a generally V-shaped sewn edge of a folded ply; and means for stacking a plurality of sewn folded plies to form a stack of sewn folded plies.

7. The apparatus of claim 6, further comprising means for transferring the ply from said folding means through said sewing means and to said stacking means while continuously contacting the ply.

8. The apparatus of claim 6, wherein said folding means comprises a fold over rod, an air manifold having a plurality of air jets, a supply of compressed air for said air jets, and means for moving said air manifold into a position for blowing a portion of the ply over said fold over rod so as to form the folded region in the ply of material.

9. The apparatus of claim 6, wherein said edge folding means comprises:

a bottom fold blade unit comprising an upper fold blade and a lower fold blade, said upper fold blade being recessed with respect to said lower fold blade such that a leading edge of an unfolded ply is adjacent said upper fold blade and resting atop said lower fold blade;

a top fold blade having a shape corresponding to the shape of said leading edge of the ply and being displaced a predetermined edge fold distance from said bottom fold blade unit;

means for engaging the ply along the entire length thereof with said top fold blade such that a predetermined length of the leading edge extends outwardly of said top fold blade, means for moving said bottom fold blade unit toward said top fold blade said predetermined edge fold distance to cause said top fold blade to extend into a gap between said lower fold blade and said upper fold blade of said bottom fold blade unit and conform the leading edge to said top fold blade, thereby forming the V-shaped tucked edge.

10. The apparatus of claim 6, wherein said sewing means comprises a sewing machine, transportable clamping means for moving a ply through said sewing machine while holding the tucked edge and folded region, means for biasing said clamping means against a pattern cam to impart a pattern in the stitch made by said sewing machine, and synchronizing means for synchronizing the movement of said carriage means through said sewing machine during sewing.

11. The apparatus of claim 6, wherein said stacking means comprises:

a stacking surface for holding a stack of workpieces;

means for positively depositing a sewn folded ply on the top of the stack of sewn folded plies on said stacking surface;

means for lowering said stacking surface a predetermined distance to provide movement clearance for said depositing means with respect to the top of the stack of sewn folded plies;

means for rotating said stacking surface a predetermined angular amount to distribute ply thickness; and means for raising said stacking surface to place the top of the stack in position to receive another ply from said depositing means.

12. An apparatus for forming a folded pocket ply of material having a generally V-shaped seam, comprising:

means for forming a tucked edge along one outer edge of a generally V-shaped section of a ply of material holding means for holding the tucked edge;

means for folding the material to form a folded region while said holding means holds said tucked edge; and means for sewing said tucked edge and said folded region to form a generally V-shaped edge on the ply.

13. The apparatus of claim 12, further comprising means for transferring the ply from said folding means through said sewing means while continuously contacting the ply.

14. The apparatus of claim 12, wherein said edge forming means comprises.

a bottom fold blade unit comprising an upper fold blade and a lower fold blade, said upper fold blade being recessed with respect to said lower fold blade such that a leading edge of an unfolded ply is adjacent said upper fold blade and resting atop said lower fold blade;

a top fold blade having a shape corresponding to the shape of said leading edge of the ply and being displaced a predetermined edge fold distance from said bottom fold blade unit;

means for engaging the ply along the entire length thereof with said top fold blade such that a predetermined length of the leading edge extends outwardly of said top fold blade;

means for moving said bottom fold blade unit toward said top fold blade said predetermined edge fold distance to cause said top fold blade to extend into a gap between said lower fold blade and said upper fold blade of said bottom fold blade unit and conform the leading edge to said top fold blade, thereby forming the V-shaped tucked edge.

15. The apparatus of claim 12, wherein said folding means comprises means for folding the tucked leading edge of the ply, a fold over rod, and means for folding the ply of material over said fold over rod to form the folded region in the ply while the tucked leading edge is held by said holding means.

16. The apparatus of claim 15, wherein said folding means further comprises an air manifold having a plurality of air jets, a supply of compressed air for said air jets, and means for moving said air manifold into a position for blowing the ply over said fold over rod so as to form the folded region in the ply of material.

17. A method for sewing a patterned stitched in a folded ply of material having a folded region and a folded leading edge, comprising the steps of:

(1) moving a clamping member into position at a folding station, in juxtaposition with a folded ply, the clamping member comprising a top clamping member and a bottom clamping member;

(2) extending the clamping member from a first retracted position to a second extended position where the top clamping member and the bottom clamping member extend beyond a creased edge in the ply toward an unheld ply end;

(3) closing the top clamping member onto the bottom clamping member to clamp the folded region in the ply, holding the folded leading edge and the folded region in the ply;

(4) moving the clamping member laterally away from the folding station toward a sewing station;

(5) moving the clamping member through the sewing station to stitch the folded leading edge to the ply to form a stitched folded ply;

(6) at the sewing station, while moving the clamping member through the sewing station, biasing the clamping member against a pattern cam to impart a pattern in the stitch made by the sewing station; and (7) after completing the stitch at the sewing station, moving the clamping member laterally away from the sewing station toward another work station.

18. A method for forming a folded sewn ply of material, comprising the steps of:

(1) receiving an unfolded ply of material on a work plate positioned adjacent to a folding station;

(2) at the folding station, aligning an elongate leading edge of an unfolded ply of material along a receiving region of a bottom fold blade unit, the receiving region having a pattern corresponding to an edge fold pattern, the bottom fold unit comprising an upper fold blade and a lower fold blade, the upper fold blade being recessed with respect to the lower fold blade, such that the leading edge of the ply is adjacent the upper fold blade and resting atop the lower fold blade and the work plate;

(3) at the folding station, engaging the ply along the entire length thereof with a top fold blade such that a predetermined length of the leading edge extends outwardly of the top fold blade, the top fold blade having a shape corresponding to the shape of the leading edge of the ply, the top fold blade being displaced a predetermined edge fold distance from the bottom fold blade unit;

(4) at the folding station, moving the bottom fold blade unit toward the top fold blade siad predetermined edge fold distance to cause the top fold blade to extend into a gap between the lower fold blade and the upper fold blade of the bottom fold blade unit and conform the leading edge to the top fold blade, thereby forming a folded leading edge;

(5) at the folding station, moving a fold blade unit holding finger into contact with the fold blade unit to apply pressure to the bottom fold blade and the top fold blade and hold the fold in the folded leading edge;

(6) at the folding station, retracting the work plate away from the fold blade unit so that the unheld end of the ply falls downwardly;

(7) at the folding station, moving a fold over rod into a position adjacent the unheld ply end;

(8) at the folding station, elevating an air jet manifold positioned beneath the unheld ply end while blowing air through orifices in the manifold, to blow the unheld ply end upwardly and over the fold over rod to form a folded region in the ply, the fold over rod defining a crease edge in the ply;

(9) at the folding station, moving a top hold finger downwardly onto the folded region in the ply;

(10) moving a transportable clamping member into position at the folding station, in juxtaposition with the folded ply, the clamping member comprising a top clamping member and a bottom clamping member;

(11) at the folding station, extending the clamping member from a first retracted position to a second extended position where the top clamping member and the bottom clamping member extend beyond the crease edge in the ply toward the unheld ply end;

(12) at the folding station, closing the top clamping member onto the bottom clamping member to clamp the folded region in the ply, holding the folded leading edge and the folded region in the ply;

(13) at the folding station, removing the fold over rod from the folded region in the ply;

(14) at the folding station, removing the top hold finger from the folded region in the ply;

(15) at the folding station, removing the fold blade unit holding finger from the fold blade unit;

(16) moving the transportable clamping member laterally away from the folding station toward a sewing station;

(17) at the sewing station, moving the transportable clamping member through the sewing station to stitch the folded leading edge to the ply to form a stitched folded ply;

(18) at the sewing station, while moving the transportable clamping member through the sewing station, biasing the clamping member against a pattern cam to impart a pattern in the stitch made by the sewing station;

(19) after completing the stitch at the sewing station, moving the transportable clamping member laterally away from the sewing station toward a stacking station;

(20) stopping the transportable clamping member when the stitched folded ply is resting on a stack plate member at the stacking station, the stack plate member being positioned in an initial position disposed over a stack of plies;

(21) at the stacking station, moving a stack hold finger onto the stitched folded ply to hold the ply against the stack plate member;

(22) releasing the top clamping member from engagement with the bottom clamping member to release the stitched folded ply at the stacking station on the stack plate member;

(23) moving the transportable clamping member away from the stacking station;

(24) moving the stack plate member away from under the stitched folded ply to a second retracted position to expose the top of a stack of plies and place the stitched folded ply in contact with the top of the stack of plies;

(25) moving the stack hold finger away from the stitched folded ply, which now forms the top of the stack of plies;

(26) lowering the stack of plies a predetermined distance to provide clearance for the return of the stack plate member;

(27) rotating the stack of plies a predetermined angular amount;

(28) returning the stack plate member to its initial position for receiving another stitched folded ply; and

(29) raising the rotated stack of plies under the stack plate member to place the top of the stack in juxtaposition with the bottom of the stack plate member.

19. An apparatus for retrieving a folded ply of material having a folded region and a folded leading edge from an initial work station and for sewing a patterned stitched in the folded ply of material at a sewing station, comprising:

clamping means for holding the folded region and the folded leading edge along the entire length of the folded leading edge, said clamping member comprising a top clamping member and a bottom clamping member;

means for moving said clamping means into position at said initial work station, in juxtaposition with the folded ply;

means for extending said clamping means from a first retracted position to a second extended position where said top clamping member and said bottom clamping member extend beyond a creased edge in the ply toward an unheld ply end;

means for closing said top clamping member onto said bottom clamping member to clamp the folded region in the ply, holding the folded leading edge and the folded region in the ply;

means for moving said clamping means laterally away from said initial work station toward said sewing station;

means for moving said clamping means through said sewing station in synchronization with a sewing machine at said sewing station, to stitch the folded leading edge to the ply to form a stitched folded ply; and means for biasing said clamping means against a pattern cam to impart a pattern in the stitch made by said sewing station while moving said clamping means through said sewing station.

20. The apparatus of claim 19, further comprising means for moving said clamping means laterally away from said sewing station toward another work station after completing the stitch at the sewing station.

21. An apparatus for forming a folded sewn ply of material, comprising:

(1) a folding station, comprising:

a work plate for receiving an unfolded ply of material;

a bottom fold blade unit comprising a receiving region having a pattern corresponding to an edge fold pattern, an upper fold blade and a lower fold blade, said upper fold blade being recessed with respect to said lower fold blade such that an elongate leading edge of an unfolded ply placed on said work plate may be aligned adjacent said upper fold blade and resting atop said lower fold blade and said work plate;

a top fold blade;

means for engaging the ply along the entire length thereof with said top fold blade such that a predetermined length of the leading edge extends outwardly of said top fold blade, said top fold blade having a shape corresponding to the shape of the leading edge of the ply, said top fold blade being displaced a predetermined edge fold distance from the bottom fold blade unit;

means for moving said bottom fold blade unit toward said top fold blade said predetermined edge fold distance to cause said top fold blade to extend into a gap between said lower fold blade and said upper fold blade of said bottom fold blade unit and conform the leading edge to said top fold blade, thereby forming a folded leading edge;

a fold blade unit holding finger;

means for moving said fold blade unit holding finger into contact with said fold blade unit to apply pressure to said bottom fold blade and said top fold blade and hold the fold in the folded leading edge;

means for retracting said work plate away from said fold blade unit so that the unheld end of the ply falls downwardly;

a fold over rod for defining a crease edge in the ply when folded;

means for moving said fold over rod into a position adjacent the unheld ply end;

an air jet manifold positioned beneath the unheld ply end including a plurality of air jets;

means for elevating said air jet manifold while blowing air through said air jets, to blow the unheld ply end upwardly and over said fold over rod to form a folded region in the ply;

a top hold finger; and means for moving said top hold finger downwardly onto the folded region in the ply;

(2) transportable clamping means comprising a top clamping member and a bottom clamping member for moving a ply between work stations;

(3) means for moving said clamping means into position at the folding station, in juxtaposition with the folded ply, for retrieving a folded ply;

(4) means for extending said clamping means from a first retracted position to a second extended position where said top clamping member and said bottom clamping member extend beyond the crease edge in the ply toward the unheld ply end;

(5) means for closing said top clamping member onto said bottom clamping member to clamp the folded region in the ply and hold the folded leading edge and the folded region in the ply;

(6) means for moving said clamping means laterally away from said folding station toward a sewing station;

(7) a sewing station, comprising:

a sewing machine;

means for moving said clamping means through said sewing machine to stitch the folded leading edge to the ply to form a stitched folded ply;

means for biasing said clamping means against a pattern cam to impart a pattern in the stitch made by said sewing machine while moving said clamping means through said sewing machine;

(8) means for moving said clamping means laterally away from said sewing station toward a stacking station after completing the stitch at said sewing station;

(9) a stacking station, comprising:

a stack plate member alternatively positionable in an initial position disposed over a stack of plies and a second retracted position;

means for stopping said clamping means when the stitched folded ply is resting on said stack plate member;

a stack hold finger for holding the ply against said stack plate member;

means for moving said stack hold finger onto the stitched folded ply to hold the ply against said stack plate member;

means for releasing said top clamping member from engagement with said bottom clamping member to release the stitched folded ply at said stacking station on said stack plate member;

means for moving said stack plate member away from under the stitched folded ply to said second retracted position to expose the top of the stack of plies and place the stitched folded ply in contact with the top of the stack of plies;

means for moving said stack hold finger away from the stitched folded ply on the top of the stack of plies;

means for lowering the stack of plies a predetermined distance to provide clearance for the return of said stack plate member;

means for rotating the stack of plies a predetermined angular amount;

means for returning said stack plate member to its initial position for receiving another stitched folded ply; and means for raising the rotated stack of plies under the stack plate member to place the top of the stack in juxtaposition with the bottom of said stack plate member; and

(10) means for moving said clamping means away from said stacking station back to said folding station after depositing the stitched folded ply.

22. The apparatus of claim 21, further comprising:

means for removing said fold over rod from the folded region in the ply;

means for removing said top hold finger from the folded region in the ply; and means for removing said fold blade unit holding finger from contact with said fold blade unit, whereby the folded ply is released to be transported by said clamping means from said folding station to said sewing station.

23. The apparatus of claim 1, wherein said detecting means comprises an encoder positioned to monitor rotation of a motor drive shaft of said sewing machine, said encoder generating said sewing speed signal.

24. The apparatus of claim 23, wherein said carriage means for moving said clamping means comprises a linear actuator driven by a stepper motor, and wherein said synchronizing means operates said stepper motor responsive to said sewing speed signal from said encoder.

* * * * *